US008845391B2

(12) United States Patent
Sone et al.

(10) Patent No.: US 8,845,391 B2
(45) Date of Patent: Sep. 30, 2014

(54) SUBSTRATE POLISHING APPARATUS, SUBSTRATE POLISHING METHOD, AND APPARATUS FOR REGULATING TEMPERATURE OF POLISHING SURFACE OF POLISHING PAD USED IN POLISHING APPARATUS

(75) Inventors: Tadakazu Sone, Tokyo (JP); Yasuyuki Motoshima, Tokyo (JP); Toru Maruyama, Tokyo (JP); Katsutoshi Ono, Tokyo (JP); Yoichi Shiokawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 649 days.

(21) Appl. No.: 12/974,123

(22) Filed: Dec. 21, 2010

(65) Prior Publication Data

US 2011/0159782 A1 Jun. 30, 2011

(30) Foreign Application Priority Data

Dec. 28, 2009 (JP) ..... 2009-298965

(51) Int. Cl.

| | |
|---|---|
| ***B24B 1/00*** | (2006.01) |
| ***B24B 55/02*** | (2006.01) |
| ***B24B 37/015*** | (2012.01) |
| ***B24B 37/34*** | (2012.01) |
| ***B24B 37/10*** | (2012.01) |

(52) U.S. Cl.

CPC ..... *B24B 37/015* (2013.01); *B24B 55/02* (2013.01); *B24B 37/34* (2013.01); *B24B 37/10* (2013.01)

USPC ..... 451/7; 451/5; 451/41

(58) Field of Classification Search

USPC ..... 451/5, 7, 8, 41

See application file for complete search history.

(56) References Cited

U.S. PATENT DOCUMENTS

| | | | | |
|---|---|---|---|---|
| 4,450,652 | A * | 5/1984 | Walsh | 451/7 |
| 6,012,967 | A | 1/2000 | Satake et al. | |
| 6,896,586 | B2 * | 5/2005 | Pham et al. | 451/7 |
| 7,837,534 | B2 * | 11/2010 | Aiyoshizawa et al. | 451/7 |
| 7,848,840 | B2 * | 12/2010 | Dao et al. | 700/121 |
| 2002/0009953 | A1 * | 1/2002 | Swanson | 451/53 |
| 2002/0107604 | A1 * | 8/2002 | Riley et al. | 700/121 |
| 2003/0186623 | A1 * | 10/2003 | Pham et al. | 451/7 |
| 2005/0221514 | A1 * | 10/2005 | Pasadyn et al. | 438/14 |
| 2007/0021263 | A1 * | 1/2007 | Moore et al. | 475/220 |

(Continued)

FOREIGN PATENT DOCUMENTS

| | | |
|---|---|---|
| JP | 3672685 | 6/1998 |
| JP | 2007-181910 | 7/2007 |
| JP | 2008-307630 | 12/2008 |

(Continued)

*Primary Examiner* — Maurina Rachuba

(74) *Attorney, Agent, or Firm* — Wenderoth, Lind & Ponack, L.L.P.

(57) ABSTRACT

An apparatus for polishing a substrate includes a rotatable polishing table supporting a polishing pad, a substrate holder configured to hold the substrate and press the substrate against a polishing surface of the polishing pad on the rotating polishing table so as to polish the substrate, and a pad-temperature detector configured to measure a temperature of the polishing surface of the polishing pad. The apparatus also includes a pad-temperature regulator configured to contact the polishing surface to regulate the temperature of the polishing surface, and a temperature controller configured to control the temperature of the polishing surface by controlling the pad-temperature regulator based on information on the temperature of the polishing surface detected by the pad-temperature detector.

21 Claims, 26 Drawing Sheets

(56) References Cited

U.S. PATENT DOCUMENTS

| | | | | |
|---|---|---|---|---|
| 2007/0054599 | A1* | 3/2007 | Taylor et al. | 451/6 |
| 2007/0125661 | A1* | 6/2007 | Wang et al. | 205/651 |
| 2007/0135020 | A1 | 6/2007 | Nabeya | |
| 2008/0311823 | A1* | 12/2008 | Aiyoshizawa et al. | 451/7 |
| 2009/0177310 | A1* | 7/2009 | Dao et al. | 700/121 |
| 2010/0081360 | A1 | 4/2010 | Xu et al. | |

FOREIGN PATENT DOCUMENTS

| | | |
|---|---|---|
| TW | 544365 | 8/2003 |
| TW | 1665642 | 9/2005 |
| TW | 200910441 | 3/2009 |

* cited by examiner

FIG. 2A

| ITEMS | Step1 | Step2 | Step3 | ..... | Step10 |
|---|---|---|---|---|---|
| PROCESSING TIME | 5 | 100 | 30 | | 30 |
| ROTATIONAL SPEED | 10 | 20 | 30 | | |
| . | | | | | |
| . | | | | | |
| . | | | | | |
| . | | | | | |
| POLISHING PAD TEMPERATURE CONTROL | Invalid | Valid | Valid | | Invalid |
| SET VALUE OF TEMPERATURE (°C) | | 45 | 40 | | |

FIG. 2B

| ITEMS | Step1 | Step2 | Step3 | ····· | Step10 |
|---|---|---|---|---|---|
| PROCESSING TIME | 5 | 100 | 30 | | 30 |
| ROTATIONAL SPEED | 10 | 20 | 30 | | |
| · | | | | | |
| · | | | | | |
| · | | | | | |
| · | | | | | |
| POLISHING PAD TEMPERATURE CONTROL | Invalid | Valid | Valid | | Invalid |
| PID PARAMETER FOR HEATING | | A | | | |
| PID PARAMETER FOR COOLING | | a | b | | |
| SET VALUE OF TEMPERATURE (°C) | | 45 | 40 | | |

SUBSTRATE POLISHING APPARATUS, SUBSTRATE POLISHING METHOD, AND APPARATUS FOR REGULATING TEMPERATURE OF POLISHING SURFACE OF POLISHING PAD USED IN POLISHING APPARATUS

BACKGROUND OF THE INVENTION

1. Field of the Invention

The present invention relates to a substrate polishing apparatus and a substrate polishing method for polishing a surface of a substrate, such as a semiconductor substrate, by holding the substrate with a substrate holding mechanism, pressing the substrate against a polishing surface of a polishing pad on a polishing table, and causing relative movement between the surface of the substrate and the polishing surface of the polishing pad. The present invention also relates to an apparatus for regulating a temperature of the polishing surface of the polishing pad used in the substrate polishing apparatus.

2. Description of the Related Art

A chemical mechanical polishing (CMP) apparatus has been known as an apparatus for polishing a surface of a substrate, such as semiconductor substrate. Typically, this apparatus has a polishing table, a polishing pad attached to an upper surface of the polishing table, and a substrate holding mechanism (which will be hereinafter referred to as a top ring). The polishing pad provides a polishing surface for polishing the substrate. The substrate, to be polished, is held by the top ring and pressed against the polishing surface of the polishing pad, while slurry is supplied onto the polishing surface. The polishing table and the top ring are rotated to cause relative movement between the polishing surface and the surface of the substrate, thereby polishing and planarizing the surface of the substrate.

It is important for an approach to finer semiconductor device to uniformly polish the surface of the substrate in the CMP apparatus. To achieve uniform polishing of the surface of the substrate, there has been an attempt to regulate contact pressure of the substrate surface against the polishing surface so as to optimize pressure distribution within the surface of the substrate.

However, a polishing rate of the substrate surface is affected not only by the contact pressure on the polishing surface, but also by a temperature of the polishing surface, a concentration of the slurry supplied, and the like. Therefore, it is not possible to completely control the polishing rate only by regulating the contact pressure on the polishing surface. In particular, in a CMP process in which the polishing rate highly depends on the temperature of the polishing surface (e.g., in a case where a surface hardness of the polishing pad highly depends on the temperature thereof), the polishing rate varies from portion to portion of the substrate surface due to temperature distribution in the polishing surface. As a result, a uniform polishing profile cannot be obtained. Generally, the temperature of the polishing surface of the polishing pad is not uniform because of heat generation of the polishing surface itself due to contact with the surface of the substrate and due to contact with a retainer ring of the top ring provided for retaining the substrate, a variation in heat absorptivity of the polishing surface, flow behavior of the slurry supplied onto the polishing surface, and the like. Therefore, there are temperature differences in regions of the polishing surface.

SUMMARY OF THE INVENTION

The present invention has been made in view of the above drawbacks. It is therefore an object of the present invention to provide a substrate polishing apparatus and a substrate polishing method for polishing a substrate while measuring a temperature of a polishing surface of a polishing pad and feeding back the measured temperature information so as to regulate the temperature of the polishing surface via proportional integral derivative (PID) control. Another object of the present invention is to provide an apparatus for regulating the temperature of the polishing surface of the polishing pad used in the substrate polishing apparatus.

Still another object of the present invention is to provide a substrate polishing apparatus and an apparatus for regulating a temperature of a polishing surface of a polishing pad having a temperature-regulating function (i.e., heating function and cooling function) capable of keeping a pad surface temperature constant during an entire polishing time or during each part of the polishing time to thereby obtain an optimum polishing rate and an optimum step property, to prevent deterioration of slurry, and to polish the surface of the substrate uniformly.

One aspect of the present invention for achieving the above object is a substrate polishing apparatus for polishing a substrate. The apparatus includes: a rotatable polishing table on which a polishing pad is attached; at least one substrate holder configured to hold a substrate and press the substrate against a polishing surface of the polishing pad on the rotating polishing table so as to polish the substrate; a pad-temperature detector configured to detect a temperature of the polishing surface of the polishing pad; a pad-temperature regulator configured to contact the polishing surface of the polishing pad to regulate the temperature of the polishing surface; and a temperature controller configured to control the temperature of the polishing surface of the polishing pad by controlling the pad-temperature regulator based on information on the temperature of the polishing surface detected by the pad-temperature detector. The temperature controller is configured to select a predetermined PID parameter from several kinds of PID parameters based on a predetermined rule and to control the temperature of the polishing surface of the polishing pad using the selected PID parameter based on the information on the temperature of the polishing surface.

In a preferred aspect of the present invention, the temperature controller is configured to select the predetermined PID parameter from the several kinds of PID parameters in accordance with a type of film of the substrate.

In a preferred aspect of the present invention, the temperature controller stores therein the several kinds of PID parameters including a PID parameter for cooling the polishing surface of the polishing pad and a PID parameter for heating the polishing surface of the polishing pad.

In a preferred aspect of the present invention, the PID parameter is registered in advance in a recipe and the temperature controller selects the PID parameter in accordance with the recipe.

In a preferred aspect of the present invention, the pad-temperature regulator has a solid member having a contact surface which is brought into contact with the polishing surface of the polishing pad, the contact surface extends in a radial direction of the polishing surface, and the pad-temperature regulator is configured to perform heat exchange between a fluid flowing in the solid member and the polishing pad through the contact surface of the solid member.

In a preferred aspect of the present invention, the substrate polishing apparatus further includes: a head section for supporting the substrate holder; and a hot-blast heater configured to blow hot gas onto the polishing surface of the polishing pad. The hot-blast heater is provided on the head section.

In a preferred aspect of the present invention, the substrate polishing apparatus further includes a cold-gas blower configured to blow cold gas onto the polishing surface of the polishing pad.

In a preferred aspect of the present invention, the substrate polishing apparatus further includes a substrate heating device configured to heat the substrate when held by the substrate holder.

In a preferred aspect of the present invention, the substrate heating device comprises a hot-water supplying device configured to supply hot water onto the substrate.

In a preferred aspect of the present invention, the at least one substrate holder comprises substrate holders, and the pad-temperature detector, the pad-temperature regulator, and the temperature controller are provided for each of the substrate holders.

Another aspect of the present invention is to provide a substrate polishing apparatus for polishing a substrate. The apparatus includes: a rotatable polishing table on which a polishing pad is attached; at least one substrate holder configured to hold a substrate and press the substrate against a polishing surface of the polishing pad on the rotating polishing table so as to polish the substrate; a pad-temperature detector configured to detect a temperature of the polishing surface of the polishing pad; a pad-temperature regulator configured to contact the polishing surface of the polishing pad to regulate the temperature of the polishing surface; and a temperature controller configured to control the temperature of the polishing surface of the polishing pad by controlling the pad-temperature regulator based on information on the temperature of the polishing surface detected by the pad-temperature detector. The temperature controller is configured to control the temperature of the polishing surface of the polishing pad using a predetermined PID parameter.

Still another aspect of the present invention is to provide a method of polishing a substrate by pressing the substrate against a polishing surface of a polishing pad on a rotating polishing table. The method includes: selecting a predetermined PID parameter from several kinds of PID parameters based on a predetermined rule; bringing a pad-temperature regulator into contact with the polishing surface of the polishing pad; controlling a temperature of the polishing surface of the polishing pad by controlling the pad-temperature regulator using the selected PID parameter based on information on the temperature of the polishing surface; and polishing the substrate while controlling the temperature of the polishing surface.

Still another aspect of the present invention is to provide a pad-temperature regulating apparatus for regulating a temperature of a polishing surface of a polishing pad for use in a substrate polishing apparatus. The pad-temperature regulating apparatus includes: a solid member including a pad contact member and an insulating cover disposed on the pad contact member. The pad contact member has a contact surface to be brought into contact with the polishing surface of the polishing pad, the pad contact member is made of ceramics, the insulating cover is arranged at an opposite side of the contact surface, the insulating cover is made of material whose linear expansion coefficient is close to that of the pad contact member, and the solid member is configured to perform heat exchange between a fluid flowing in the solid member and the polishing surface of the polishing pad through the contact surface.

In a preferred aspect of the present invention, the pad contact member is made of SiC or alumina.

In a preferred aspect of the present invention, the contact surface of the solid member comprises a mirror-finished contact surface, or a chemical vapor deposition (CVD) coating is applied to the contact surface for reducing surface roughness of the contact surface.

In a preferred aspect of the present invention, the pad-temperature regulating apparatus further includes a follow mechanism configured to allow the solid member to follow deflection of the polishing surface in a circumferential direction and a radial direction and to follow a change in thickness of the polishing pad as a result of wear thereof. The solid member is shaped so as to extend in the radial direction and is placed in contact with the polishing surface by its own weight.

In a preferred aspect of the present invention, the pad-temperature regulating apparatus further includes a raising mechanism capable of raising up the solid member to an upright position at a periphery of the polishing pad so that the solid member does not hinder replacement of the polishing pad.

In a preferred aspect of the present invention, the solid member has at least one first fluid port provided on one end portion thereof located at a center-side portion of the polishing pad and at least one second fluid port provided on the other end portion thereof located at a periphery-side portion of the polishing pad, and the fluid is introduced into and discharged from the solid member through the first fluid port and the second fluid port.

In a preferred aspect of the present invention, when cooling the polishing surface of the polishing pad, the fluid is supplied into the first fluid port located at the center-side portion of the polishing surface and is discharged from the second fluid port located at the periphery-side portion of the polishing pad.

In a preferred aspect of the present invention, when heating the polishing surface of the polishing pad, the fluid is supplied into the second fluid port located at the periphery-side portion of the polishing pad and is discharged from the first fluid port located at the center-side portion of the polishing surface.

In a preferred aspect of the present invention, the at least one first fluid port comprises one fluid port, and the at least one second fluid port comprises at least two fluid ports.

In a preferred aspect of the present invention, the solid member has a trapezoidal shape, as viewed from above, which has a narrow end portion contacting a center-side portion of the polishing pad and a wide end portion contacting a periphery-side portion of the polishing pad.

In a preferred aspect of the present invention, the fluid is liquid or gas.

In a preferred aspect of the present invention, the pad-temperature regulating apparatus further includes a proportional control three-way valve through which the fluid is supplied into the solid member. Hot fluid and cold fluid are supplied to the proportional control three-way valve, and the hot fluid and the cold fluid are mixed by the proportional control three-way valve at regulated flow rates, respectively, to form the fluid having an controlled temperature.

According to the present invention, the temperature controller selects the predetermined PID parameter from the several types of PID parameters based on the predetermined rule and controls the temperature of the polishing pad surface using the selected PID parameter based on the pad temperature information. Therefore, the polishing rate of the substrate can be optimized and can be kept constant, whereby the polishing time can be shortened. Further, as a result, an amount of slurry used and an amount of slurry discarded can be reduced.

Because the polishing time can be shortened as described above, the number of substrates processed per unit time is increased and productivity is improved. Further, a polishing cost per substrate (including costs for slurry and other consumables) can be reduced.

Because the polishing uniformity and the step property in the surface of the substrate can be improved, a yield of products in the substrate polishing process can be improved.

Because the PID parameter can be selected according to the recipe, it is possible to cope with process jobs, having various recipe information, sent from a host computer.

Because the PID parameter and the set temperature (i.e., target temperature) can be set for each polishing step during polishing, the temperature of the polishing pad can be controlled in accordance with a condition of a film to be removed from the substrate.

BRIEF DESCRIPTION OF THE DRAWINGS

FIG. 2A is a diagram showing an example of a recipe;

FIG. 2B is a diagram showing an example of a recipe;

DETAILED DESCRIPTION OF THE PREFERRED EMBODIMENTS

Figure 1:
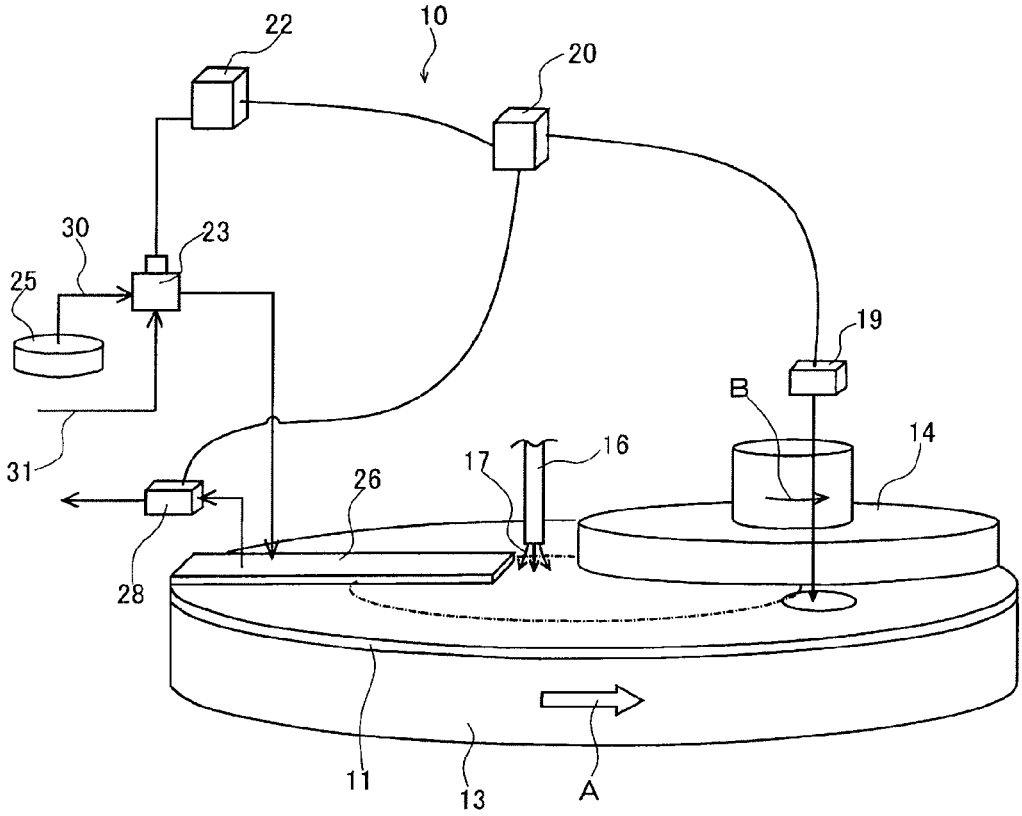
FIG. 1 is a view showing an example of a schematic structure of a substrate polishing apparatus according to the present invention.

Embodiments of the present invention will be described below in detail. FIG. 1 is a view showing an example of a schematic structure of a substrate polishing apparatus according to the present invention. As shown in the drawing, the substrate polishing apparatus 10 includes a polishing table 13 having an upper surface on which a polishing pad 11 is attached, and a top ring 14 serving as a substrate holder for holding a substrate. The polishing table 13 and the top ring 14 are rotatable. A substrate (not shown) is held on a lower surface of the top ring 14, rotated by the top ring 14, and pressed by the top ring 14 against a polishing surface of the polishing pad 11 on the rotating polishing table 13. Further, slurry 17, serving as a polishing liquid, is supplied from a slurry supply nozzle 16 onto the polishing surface of the polishing pad 11. In this manner, a surface of the substrate is polished by relative movement between the substrate and the polishing surface of the polishing pad 11.

The substrate polishing apparatus 10 further includes a radiation thermometer 19, a temperature controller 20, an electropneumatic regulator 22, a proportional control three-way valve 23, a hot-water producing tank 25, a pad-temperature regulator 26, and a thermometer 28. The radiation thermometer 19 serves as a pad-temperature detector for detecting or measuring a temperature of the polishing surface (i.e., an upper surface) of the polishing pad 11. The pad-temperature regulator 26 is configured to contact the polishing surface of the polishing pad 11 so as to regulate the temperature of the polishing surface. The thermometer 28 is arranged so as to detect or measuring a temperature of water discharged from the pad-temperature regulator 26. The radiation thermometer 19 is arranged so as to detect a temperature of a target region in the polishing surface of the polishing pad 11. This target region is adjacent to the top ring 14 on the polishing surface and located upstream of the top ring 14 with respect to a rotational direction (indicated by arrow A) of the polishing table 13. Information on the detected temperature of the polishing pad surface is inputted to the temperature controller 20.

Various kinds of PID parameters, which will be described in detail later, are stored in the temperature controller 20. A set temperature of the polishing surface of the polishing pad 11 is also stored in the temperature controller 20. The temperature controller 20 is configured to select a predetermined PID parameter from the several kinds of PID parameters in accordance with a difference between the set temperature of the polishing surface of the polishing pad 11 and the actual temperature of the polishing surface detected by the radiation thermometer 19 and to control the proportional control three-way valve 23 through the electropneumatic regulator 22 based on the information on the surface temperature of the polishing pad 11 detected by the radiation thermometer 19 so that the polishing surface of the polishing pad 11 has the set temperature. Opening degrees of the proportional control three-way valve 23 are controlled by the electropneumatic regulator 22 such that the upper surface (i.e., the polishing surface) of the polishing pad 11 has a predetermined temperature. Specifically, the proportional control three-way valve 23 controls a mixing ratio of flow rate of hot water 30 having a predetermined temperature from the hot-water producing tank 25 and flow rate of cold water 31 having a predetermined temperature and supplies temperature-controlled fluid to the pad-temperature regulator 26. The temperature of the water flowing out from the pad-temperature regulator 26 is measured by the thermometer 28, and the measured temperature is fed back to the temperature controller 20. Alternatively, the surface temperature of the polishing pad 11 measured by the radiation thermometer 19 may be fed back to the temperature controller 20. With these operations, the polishing surface of the polishing pad 11 can maintain the optimum temperature that has been set in the temperature controller 20. Therefore, a polishing rate of the substrate can be optimized and can be kept constant, and a polishing time can be shortened. Further, as a result, an amount of the slurry 17 used and an amount of the slurry 17 discarded can be reduced.

An amount of heat generated in polishing of the substrate varies depending on processing conditions including a type of film of the substrate, polishing conditions (e.g., a rotational speed of the polishing table 13 and a rotational speed of the top ring 14), and a type of the polishing pad 11. Accordingly, a surface temperature profile of the polishing pad 11 when polishing the substrate also varies depending on the processing conditions. Further, the optimum surface temperature of the polishing pad 11 when polishing the substrate also varies depending on the processing conditions. Therefore, it is necessary to provide PID parameters corresponding to the processing conditions, respectively. However, because the single substrate polishing apparatus is required to process various kinds of processing conditions, it is necessary to store several kinds of PID parameters in the temperature controller 20 and to use them selectively.

When a substrate lot is delivered to the substrate polishing apparatus 10, polishing condition recipes are transmitted from a superior computer (e.g., a host computer in a factory) to the substrate polishing apparatus 10. Therefore, by writing the PID parameters onto the polishing condition recipes, respectively, it is possible to use the PID parameters selectively through communication between a computer in the substrate polishing apparatus 10 and the temperature controller 20. The polishing condition recipe, transmitted from the superior computer, is stored in the computer of the substrate polishing apparatus 10.

Figure 3:
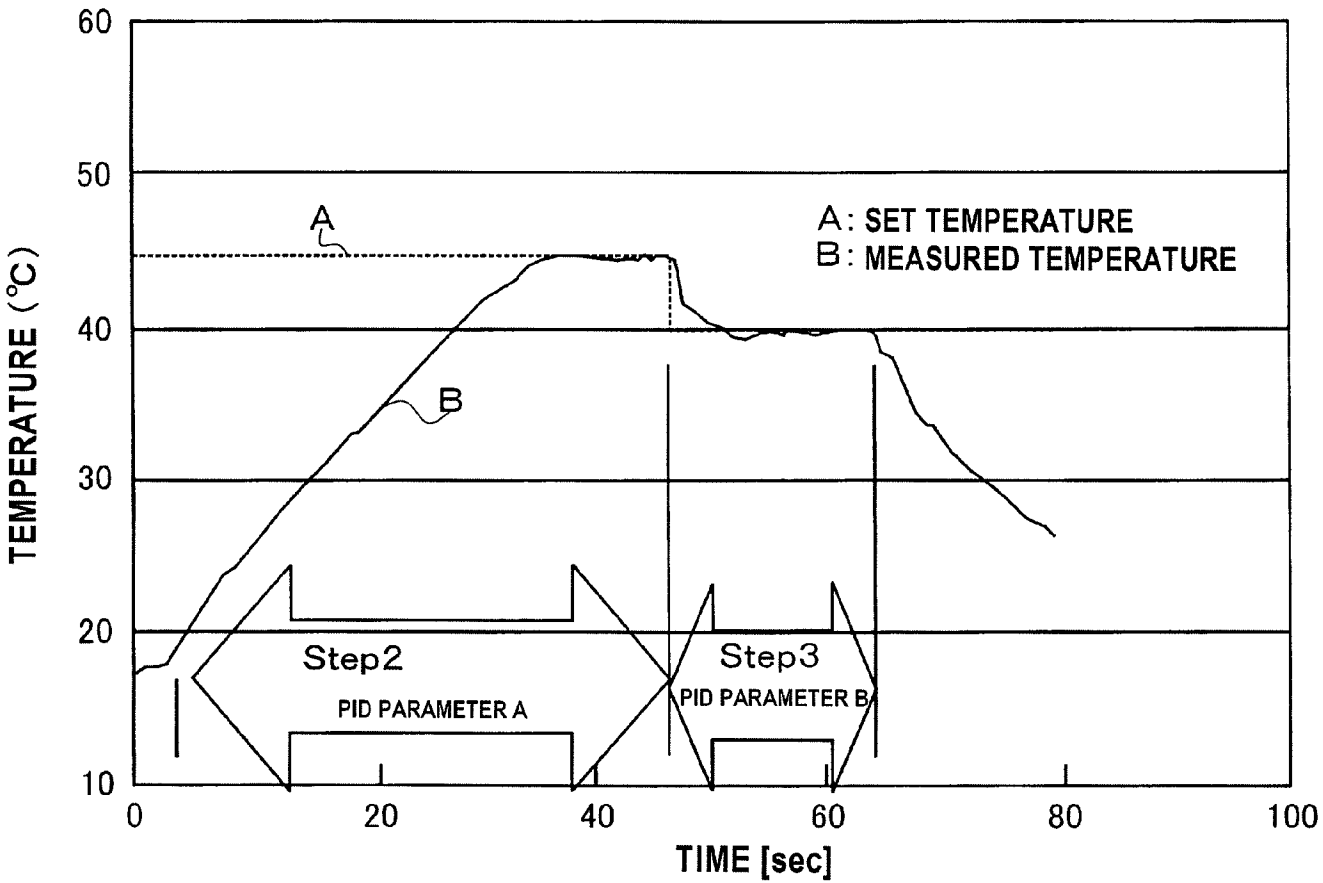
FIG. 3 is a diagram showing a relationship between substrate polishing time and surface temperature of a polishing pad.

It may be necessary to change the optimum surface temperature of the polishing pad 11 as polishing of the film of the substrate progresses. In such a case, it is also necessary to change the PID parameter according to the change in the optimum surface temperature. FIG. 2A and FIG. 2B are diagrams each showing an example of the recipe. FIG. 3 is a diagram showing a relationship between substrate polishing time [second] and surface temperature of the polishing pad. As shown in FIG. 2A and FIG. 2B, processing time, rotational speed, . . . , "invalid" or "valid" for the polishing pad temperature control, the PID parameter, and set temperature are set for each of polishing steps 1, 2, 3, . . . , and 10. The relationship between the substrate polishing time and the upper surface temperature of the polishing pad 11 is such that the set temperature in the step 2 is 45° C. and the set temperature in the step 3 is 40° C., as indicated by dotted line A in FIG. 3, while the measured temperature of the upper surface of the polishing pad 11 is as indicated by curved line B.

Figure 4:
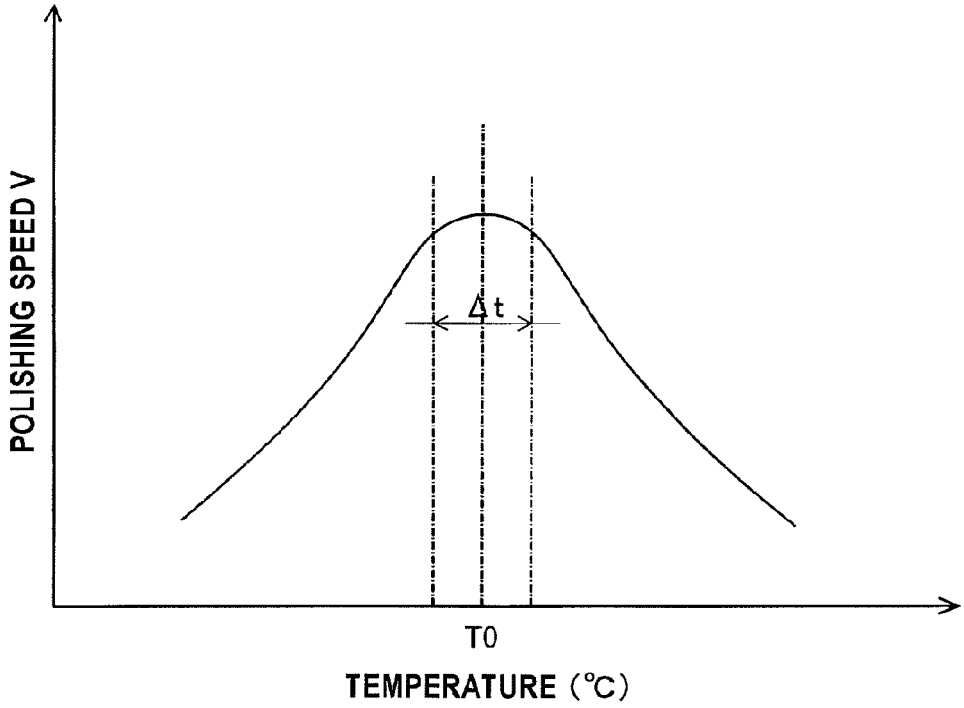
FIG. 4 is a diagram showing a relationship between polishing speed of a substrate film and temperature of the polishing pad.

In a case where a substrate, having a metal plated film formed on a surface thereof, is polished by the substrate polishing apparatus, a relationship between polishing speed V of the film and surface temperature [° C.] of the polishing pad is as indicated in FIG. 4. As shown in FIG. 4, the polishing speed V takes its maximum value when the upper surface temperature of the polishing pad 11 is $T_0$ (e.g., 45° C.). In this case, a predetermined temperature range (e.g., from 30 to 60° C.) centered at the temperature $T_0$ is determined to be an optimum set temperature range Δt for polishing.

Figure 5:
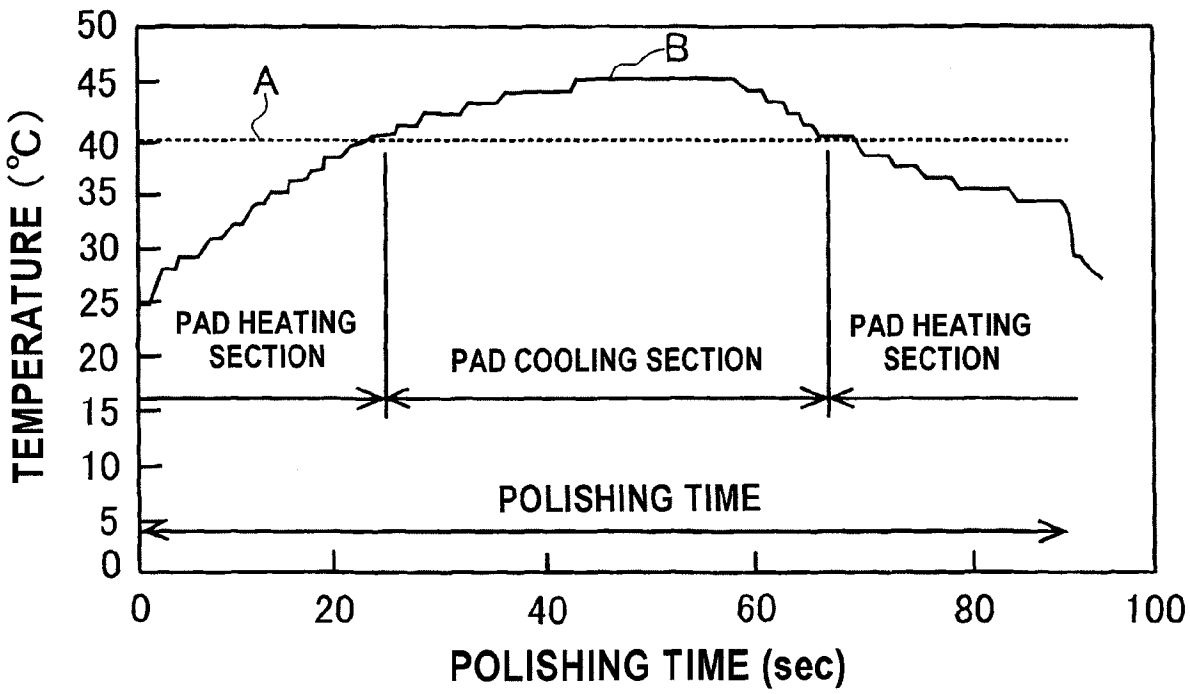
FIG. 5 is a diagram showing a relationship between substrate polishing time of a Cu film and temperature of the polishing pad.
Figure 6:
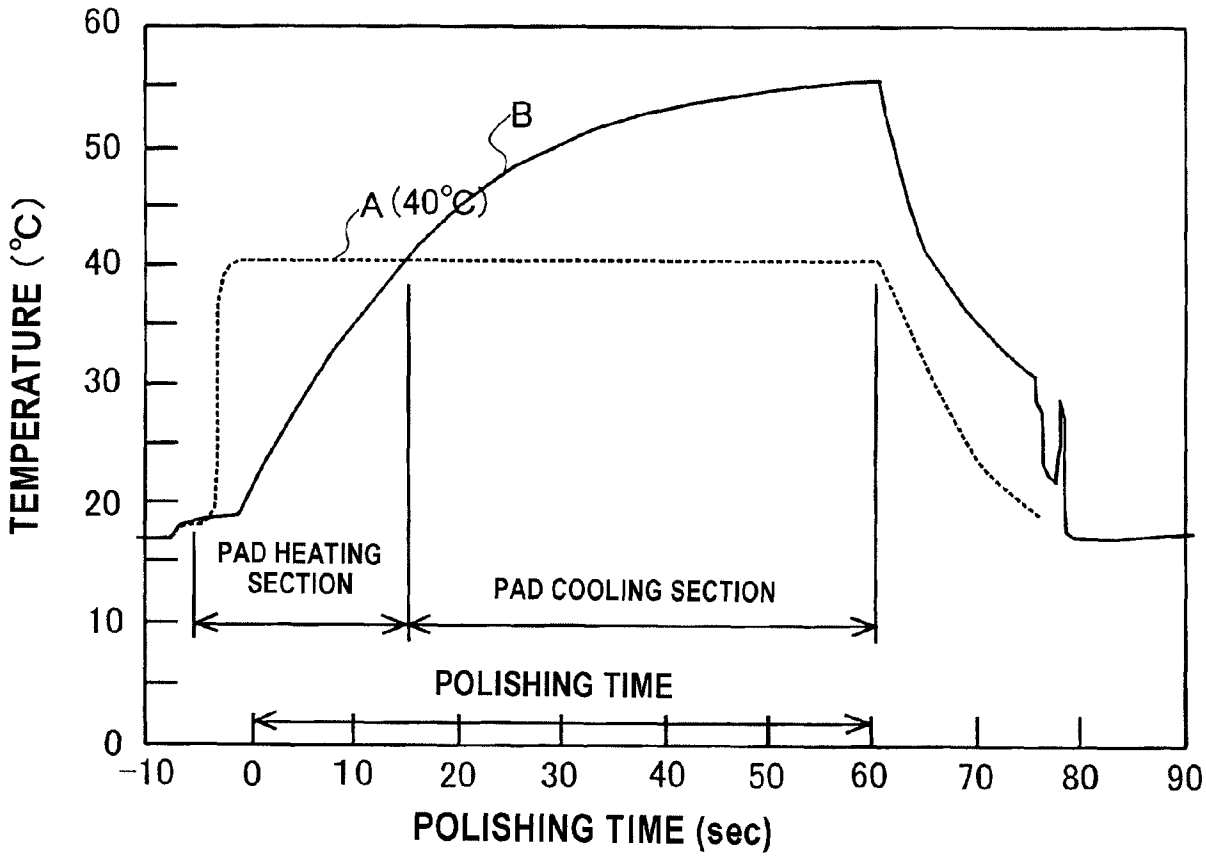
FIG. 6 is a diagram showing a relationship between substrate polishing time of a film used in STI (Shallow Trench Isolation) and temperature of the polishing pad.

FIG. 5 is a diagram showing a temperature profile of the upper surface of the polishing pad 11 when polishing a substrate having a Cu plated film formed thereon. FIG. 6 is a diagram showing a temperature profile of the polishing pad when polishing a substrate having a dielectric film formed thereon for use in STI (Shallow Trench Isolation). In the case where the substrate having the Cu plated film is polished, if the temperature control of the upper surface of the polishing pad is not performed, the temperature of the polishing pad is increased above a desired control temperature and is decreased below the desired control temperature again as indicated by a curved line B in FIG. 5, although the desired control temperature is set at a predetermined temperature (e.g., 40° C.) as indicated by a dotted line A in FIG. 5. Similarly, in the case where the substrate having the dielectric film for use in STI is polished, if the temperature control of the upper surface of the polishing pad is not performed, the temperature of the polishing pad is increased above a desired control temperature as indicated by a curved line B in FIG. 6, although the desired control temperature is set at a predetermined temperature (e.g., 40° C.) as indicated by a dotted line A in FIG. 6.

In this embodiment, the temperature of the upper surface of the polishing pad 11 is controlled over the polishing time so as to be maintained within a predetermined set temperature range (e.g., 30° C. to 60° C.) with a predetermined accuracy (e.g., with an accuracy of at most ±1° C.). More specifically, a temperature of a predetermined area of the polishing pad (e.g., an area extending along an edge (a periphery) of the polishing table 13 with a width of 30 mm, and other area) is maintained at the set temperature range. The responsibility when heating the polishing pad before polishing of the substrate is such that the temperature reaches the set temperature within five seconds. When switching the temperature during polishing of the substrate, the temperature is increased or decreased at a ratio of not less than 2° C./sec. The temperature of the polishing pad is controlled so as to reach the desired temperature (i.e., the set temperature) before polishing is started. This set temperature is maintained during polishing. There are cases where the desired temperature varies during polishing. In these cases, the temperature is changed at not less than 2° C./sec.

Figure 7A:
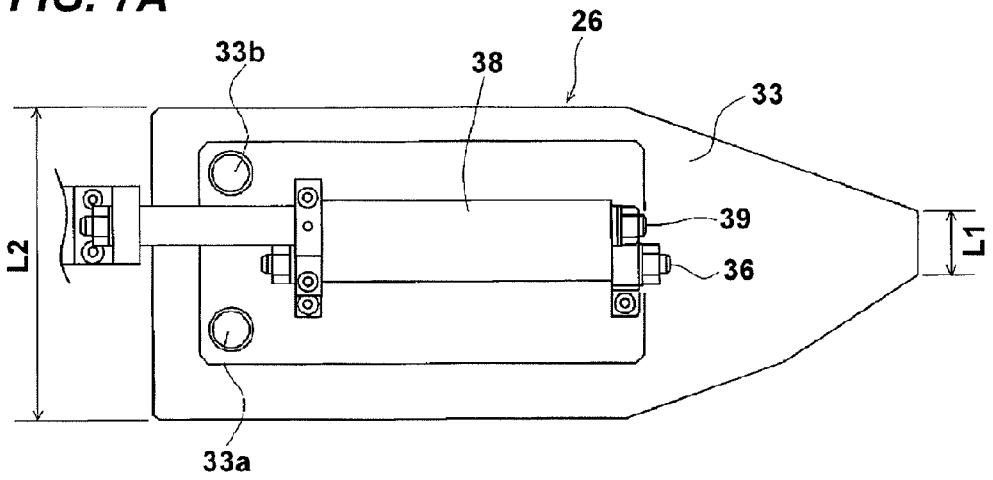
FIG. 7A through FIG. 7C are views showing a structural example of a pad-temperature regulator.
Figure 7B:
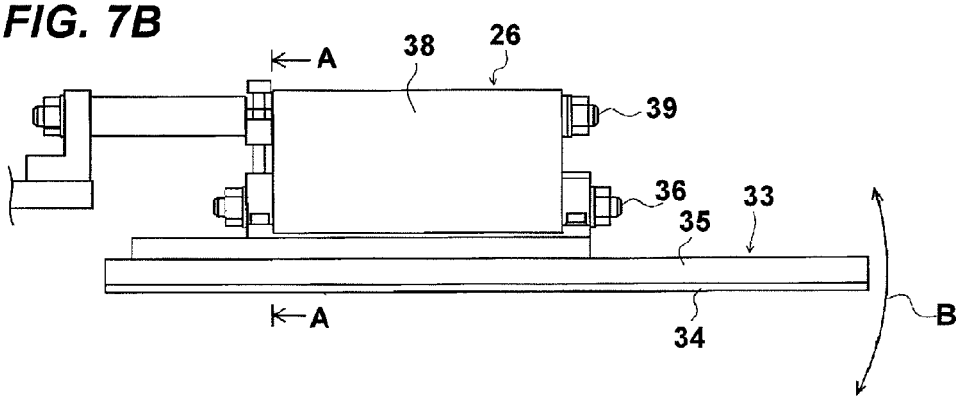
Figure 7C:
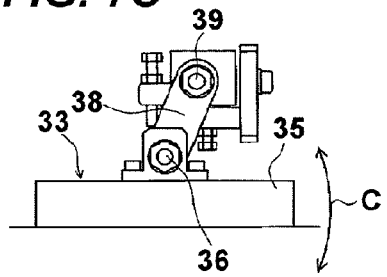

FIG. 7A is a plan view showing a structural example of the pad-temperature regulator 26, FIG. 7B is a side view showing the pad-temperature regulator 26, and FIG. 7C is a cross-sectional view taken along line A-A in FIG. 7B. The pad-temperature regulator 26 includes a solid member 33 having a pad-contact section 34 which is brought into contact with the upper surface of the polishing pad 11 on the polishing table 13. The solid member 33 has therein a fluid passage through which a fluid, serving as a heat-exchange medium, flows, as will be described later. An upper portion of the pad-contact section 34 is covered with a lid (i.e., an insulating cover) 35 which is made of material having an excellent heat insulating property. The solid member 33 has a front end portion and a rear end portion, and a width L1 of the front end portion is smaller than a width L2 of the rear end portion (i.e., L1<L2). As shown in FIG. 1, the pad-temperature regulator 26 is disposed on the upper surface of the polishing pad 11 such that the front end portion having the smaller width L1 is located on a center-side portion of the polishing pad 11 and the rear end portion having the larger width L2 is located on a periphery-side portion of the polishing pad 11. Heat exchange is performed between the fluid flowing through the solid member 33 and the upper surface of the polishing pad 11 through the pad-contact section 34, thereby regulating the upper surface temperature of the polishing pad 11 at a predetermined temperature.

The solid member 33 is secured to a mount shaft 36. This mount shaft 36 engages a bracket 38, and this bracket 38 engages a support shaft 39 for supporting the solid member 33. A predetermined gap is formed between the mount shaft 36 and the bracket 38. With these structures, the solid member 33 can pivot within a predetermined range as indicated by arrow B and arrow C, and further can move upwardly and downwardly within a predetermined range. Because the gap is formed between the bracket 38 and the mount shaft 36, the solid member 33 of the pad-temperature regulator 26 contacts the polishing pad 11 by its own weight and can follow deflection of the polishing pad 11 in a radial direction and a circumferential direction. Further, even when the polishing pad 11 has worn, the solid member 33 can follow the wear of the polishing pad 11 because the solid member 33 can move upwardly and downwardly, in addition to the deflection of the solid member 33, through the gap. A fluid inlet 33*a* for introducing the fluid (i.e., the heat-exchange medium) into the above-described fluid passage and a fluid outlet 33*b* for discharging the fluid from the fluid passage are provided on the rear end portion of the solid member 33.

Figure 8:
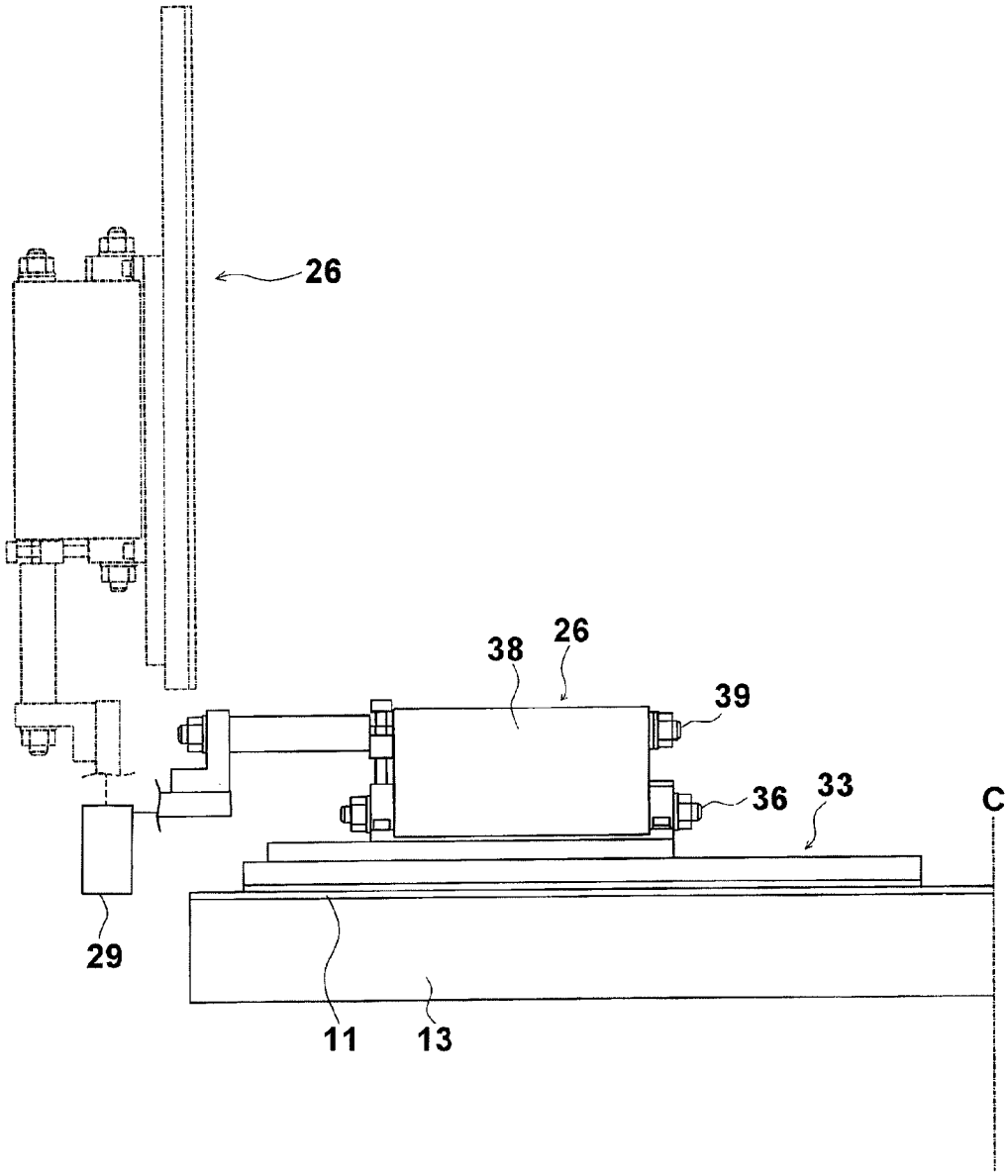
FIG. 8 is a view showing structural examples of the pad-temperature regulator and a polishing table.

The pad-temperature regulator 26 has a raising mechanism 29 capable of raising up the solid member 33 to an upright position at the periphery of the polishing table 13, as indicated by a dashed line in FIG. 8. This mechanism 29 can allow replacement of the polishing pad 11 on the upper surface of the polishing table 13 without removing the pad-temperature regulator 26 from the substrate polishing apparatus 10 by raising up the solid member 33 to the upright position at the periphery of the polishing table 13. In FIG. 8, a symbol C represents a center of rotation of the polishing table 13.

Figure 9A:
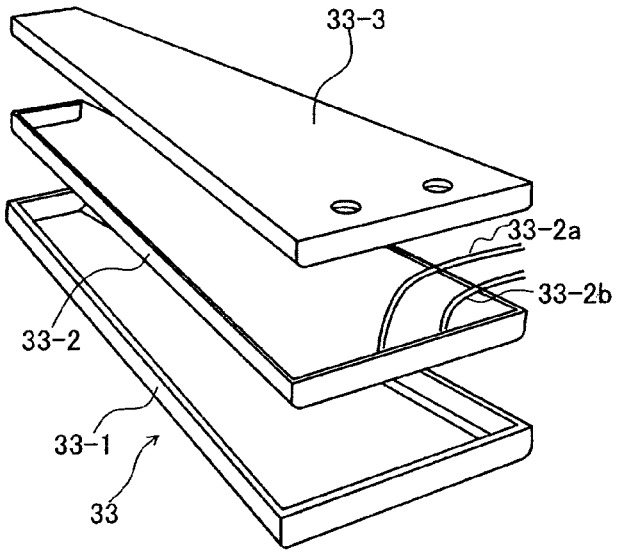
FIG. 9A through FIG. 9C are views showing an example of an interior structure of the pad-temperature regulator except for a lid.
Figure 9B:
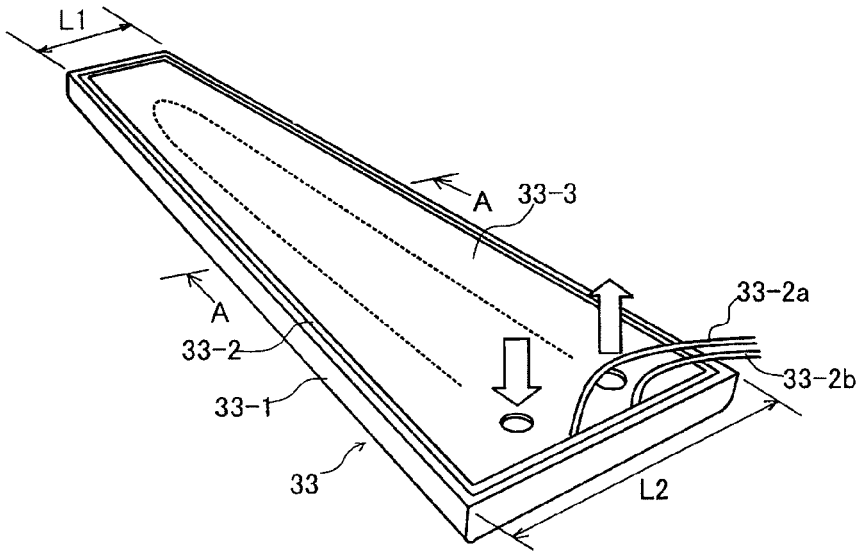
Figure 9C:
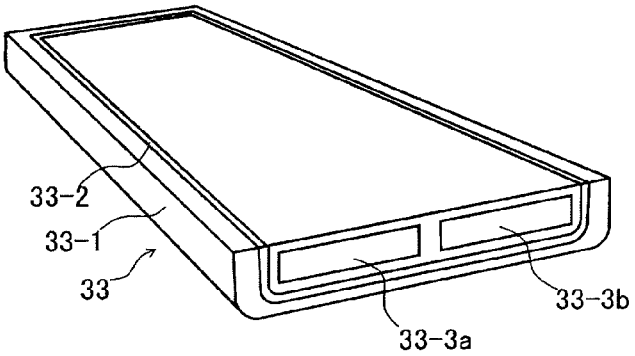

FIG. 9A is an exploded perspective view showing an example of an interior structure of the solid member 33, except for the lid 35, of the pad-temperature regulator 26, FIG. 9B is a perspective view showing the solid member 33, and FIG. 9C is a view taken along line A-A in FIG. 9B. The solid member 33 of the pad-temperature regulator 26 shown in FIGS. 7A through 7C and the solid member 33 of the pad-temperature regulator 26 shown in FIGS. 9A through 9C are slightly different in its shape as viewed from above. As shown in FIGS. 9A through 9C, the solid member 33 has a pad contact member 33-1, a silicone rubber heater 33-2, and an aluminum circulation water case 33-3. The pad contact member 33-1 has a contact surface which is brought into contact with the polishing pad 11. The pad contact member 33-1 is made of material having an excellent thermal conductivity, an excellent wear resistance, and an excellent corrosion resistance. Examples of the material of the pad contact member 33-1 include ceramics, such as SiC (silicon carbide) or alumina. The pad contact member 33-1 has a trapezoidal shape as viewed from above in which the width L1 of the front end portion is smaller than the width L2 of the rear end portion (L1<L2). The pad contact member 33-1 has a circumferential portion in the shape of vertical wall. Therefore, the pad contact member 33-1 as a whole constitutes a trapezoidal vessel.

The silicone rubber heater 33-2 has a trapezoidal shape as viewed from above and has a circumferential portion that can be inserted into the interior of the pad contact member 33-1. The aluminum circulation water case 33-3 has a trapezoidal shape as viewed from above and has a circumferential portion that can be inserted into the interior of the silicone rubber heater 33-2. An inner surface of the pad contact member 33-1 and an outer surface of the silicone rubber heater 33-2 are bonded to each other with, for example, an adhesive. The silicone rubber heater 33-2 is supplied with electric current through lead wires 33-2*a* and 33-2*b* to thereby generate heat. The aluminum circulation water case 33-3 has an incoming fluid passage 33-3*a* into which the fluid (i.e., the heat-exchange medium, such as hot water or cold water) flows and an outgoing fluid passage 33-3*b* from which the fluid is discharged.

The pad contact member 33-1 is made of ceramics (e.g., SiC or alumina) having an excellent thermal conductivity, an excellent wear resistance, and an excellent corrosion resistance. The lid 35 covering the upper portion of the pad contact member 33-1 is made of material having an excellent heat insulating property in order to increase an efficiency of heat exchange between the upper surface of the polishing pad 11 and the pad contact member 33-1 which is made of, for example, SiC. For example, the lid 35 is made of ceramics (having low heat conductivity) or resin. In the case of using resin for the lid 35, it is preferable to select PEEK (polyetheretherketone) or PPS (polyphenylene sulfide) in order to prevent heat deformation of the pad contact member 33-1 due to heat of the fluid. Alternatively, it is possible to use material whose linear expansion coefficient is close to or substantially the same as that of the pad contact member 33-1 in order to put priority on prevention of the heat deformation of the pad contact member 33-1 over the heat insulating property. Further, in order to increase the thermal efficiency, it is preferable to increase a contact area of the pad contact member 33-1 with the polishing pad 11 and to reduce a thickness of a pad-contact portion (i.e., a bottom portion) of the pad contact member 33-1 that contacts the polishing pad 11. The shape of the solid member 33 is not limited to trapezoid, and the solid member 33 may have a fan shape.

The contact surface of the pad contact member 33-1, which is to be brought into contact with the polishing pad 11, is a mirror-finished surface formed by a lapping process or the like in order to reduce surface roughness. If the contact surface of the pad contact member 33-1 is processed by a cutting technique, fine materials may fall off from the contact surface and may scratch the polished surface of the substrate during polishing. Because the contact surface to be brought into contact with the polishing pad 11 is a mirror-finished surface formed by the lapping process or the like, the solid member 33 of the pad-temperature regulator 26 contacts the upper surface of the polishing pad 11 smoothly, and a crushed layer, containing cracks produced when forming the contact surface, becomes thin. Therefore, less materials fall off and are less likely to scratch the polished surface of the substrate during polishing. In order to obtain the same result as the lapping process, CVD coating of diamond, DLC (diamond-like carbon), SiC (silicon carbide), or the like may be applied to the contact surface.

In the above-described substrate polishing apparatus, when the polishing table 13 is rotated, the periphery-side portion of the polishing pad 11 tends to be cooled due to heat of vaporization, compared with the center-side portion of the polishing pad 11. Thus, it is preferable to arrange the fluid inlet 33*a* and the fluid outlet 33*b* so as to prevent such a tendency (i.e., so as not to create temperature difference in the polishing surface of the polishing pad 11).

Figure 10A:
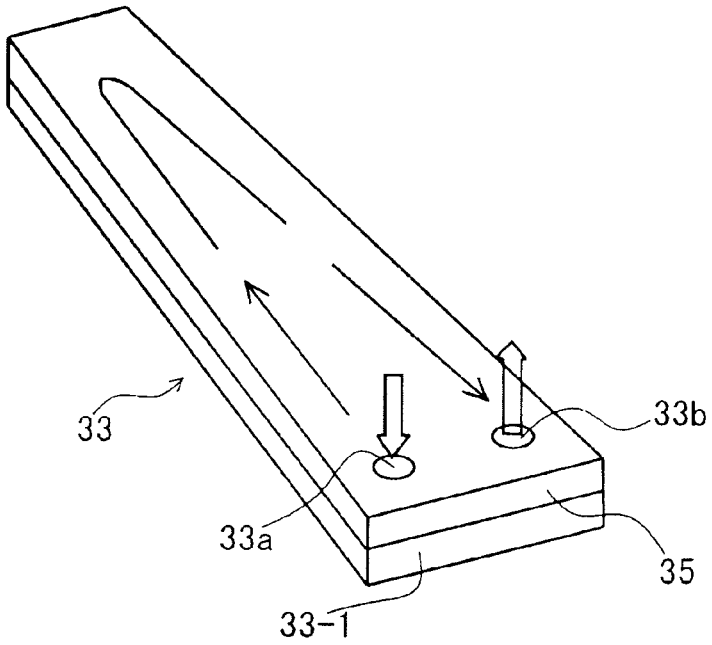
FIG. 10A and FIG. 10B are views each showing a manner of fluid flowing through a solid member of the pad-temperature regulator.

In one embodiment, as shown in FIG. 10A, the fluid inlet 33*a* and the fluid outlet 33*b* for passing cooling water through the solid member 33 are provided on the rear end portion contacting the periphery-side portion of the polishing pad 11. The fluid passage is formed in the solid member 33 such that the fluid (i.e., the cooling water) flows into the fluid inlet 33*a*, flows through the solid member 33 toward the front end portion contacting the center-side portion of the polishing pad 11, turns back at the front end portion of the solid member 33 near the center of the polishing pad 11, flows toward the rear end portion of the solid member 33 contacting the periphery-side portion of the polishing pad 11, and flows out from the fluid outlet 33*b*.

Figure 10B:
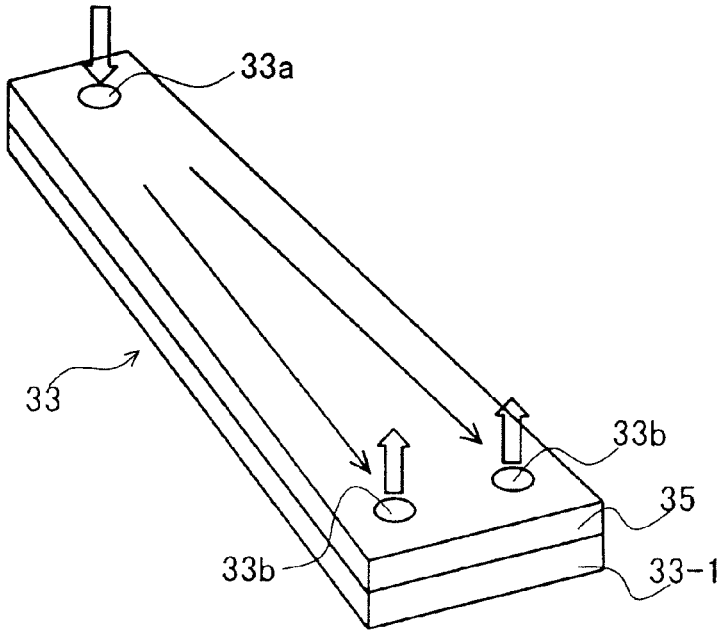
Figure 11:
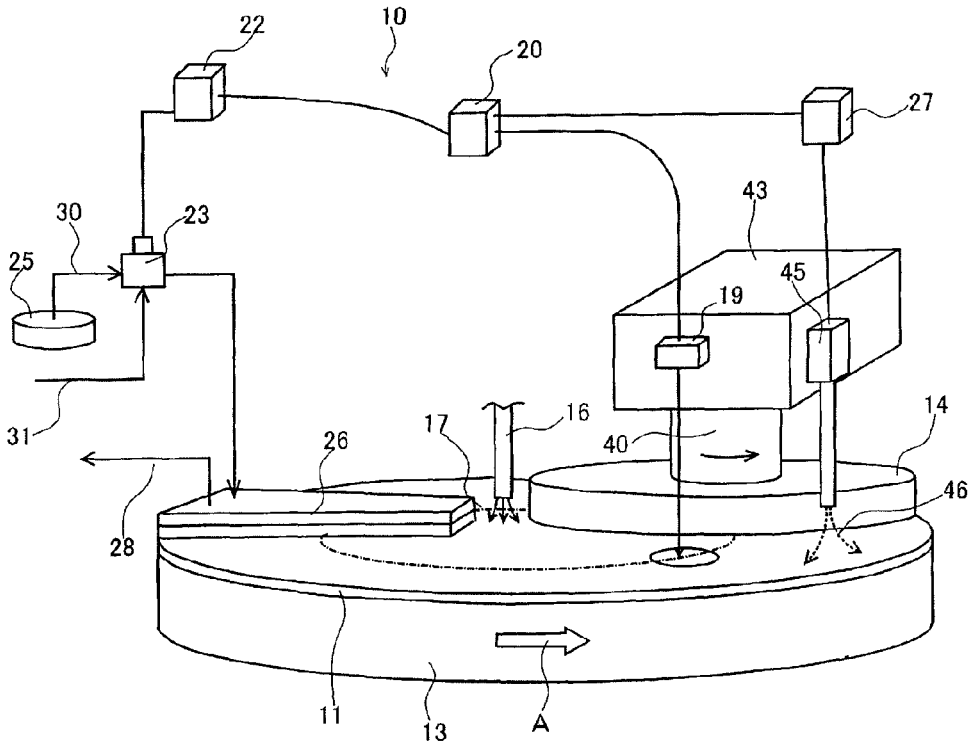
FIG. 11 is a view showing an example of a schematic structure of the substrate polishing apparatus according to the present invention.

In another embodiment, in order to improve the above-described tendency that the periphery-side portion of the polishing pad 11 is more cooled due to heat of vaporization than the center-side portion of the polishing pad 11, one fluid inlet 33*a* is provided on the front end portion of the solid member 33 contacting the center-side portion of the polishing pad 11, and two fluid outlets 33*b* are provided on the rear end portion of the solid member 33 contacting the periphery-side portion of the polishing pad 11, as shown in FIG. 10B. Fluid passages are formed such that the fluid (cooling water) is introduced into the fluid inlet 33*a*, flows through the solid member 33 toward the rear end portion, and flows out from the two fluid outlets 33*b*. With this arrangement, the initially-introduced cooling water having a low temperature flows at the center-side portion of the polishing pad 11 to thereby cool the center-side portion more greatly than the periphery-side portion of the polishing pad 11. Therefore, it is possible to suppress the tendency that the periphery-side portion of the polishing pad 11 is cooled due to heat of vaporization compared with the center-side portion of the polishing pad 11.

As described above, since the polishing table 13 rotates, the periphery-side portion of the polishing pad 11 tends to be cooled due to heat of vaporization compared with the center-side portion of the polishing pad 11. In order to suppress this tendency, a hot-blast heater 45 is installed on a top ring support arm (i.e., a head section) 43 that rotatably holds a rotational shaft 40 of the top ring 14. This hot-blast heater 45 is arranged so as to blow hot gas (e.g., hot air) onto an upstream region on the periphery-side portion of the polishing pad 11 that is located upstream of the top ring 14. In this manner, only the periphery-side portion of the polishing pad 11 is heated by the hot gas supplied from the hot-blast heater 45. Since the hot-blast heater 45 is disposed on the top ring support arm 43, it is not necessary to provide a support mechanism for supporting the hot-blast heater 45 and therefore the cost can be reduced. The top ring support arm 43 is configured to pivot and stop at a predetermined polishing position at all times. Therefore, a position of the hot-blast heater 45 relative to the polishing pad 11 is also constant at all times. Consequently, good repeatability can be obtained and the upper surface temperature of the polishing pad 11 can be controlled. The hot gas 46 from the hot-blast heater 45 is controlled based on the temperature of the periphery-side portion of the upper surface of the polishing pad 11. More specifically, the temperature controller 20 having the PID parameters performs PID control on a voltage regulator 27, or the hot gas 46 having a constant temperature blows the polishing pad 11 and only ON-OFF control of the hot gas 46 is performed.

The blowing direction of the hot gas 46 from the hot-blast heater 45 is a radially outward direction of the polishing table 13 on which the polishing pad 11 is attached or a direction against the rotational direction of the polishing table 13. By blowing the hot gas 46 in this manner, the decrease in the surface temperature of the polishing pad 11 can be minimized.

Figure 12:
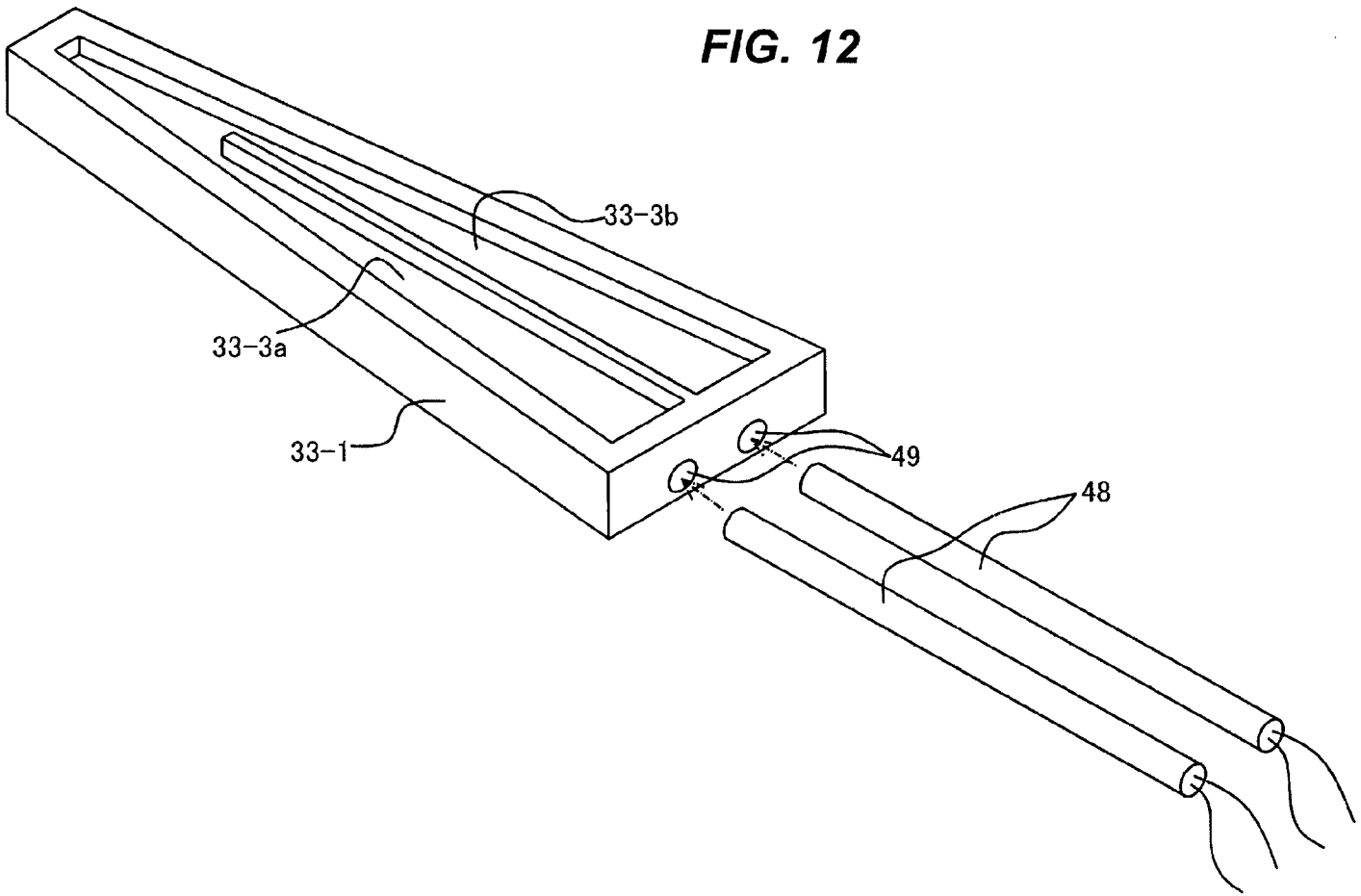
FIG. 12 is a view showing structural examples of a pad contact member of the pad-temperature regulator and a rod heater.

In the pad-temperature regulator 26 shown in FIGS. 9A through 9C, the heater (i.e., the silicone rubber heater 33-2) is disposed on the inner surface of the pad contact member 33-1, or as shown in FIG. 12, rod heaters 48 are inserted into round holes 49 formed in the pad contact member 33-1 such that the rod heaters 48 are disposed in the pad contact member 33-1. Heating of the polishing pad 11 is performed by the heater (i.e., the silicone rubber heater 33-2 or the rod heaters 48), and cooling of the polishing pad 11 is performed by passing the cold water through the incoming fluid passage 33-3*a* and the outgoing fluid passage 33-3*b* provided in the aluminum circulation water case 33-3, whereby the surface temperature of the polishing pad 11 is controlled. When the desired set temperature of the upper surface of the polishing pad 11 is high, the polishing pad 11 may be heated not only by the heater (i.e., the silicone rubber heater 33-2 or the rod heaters 48), but also by passing hot water.

Figure 14A:
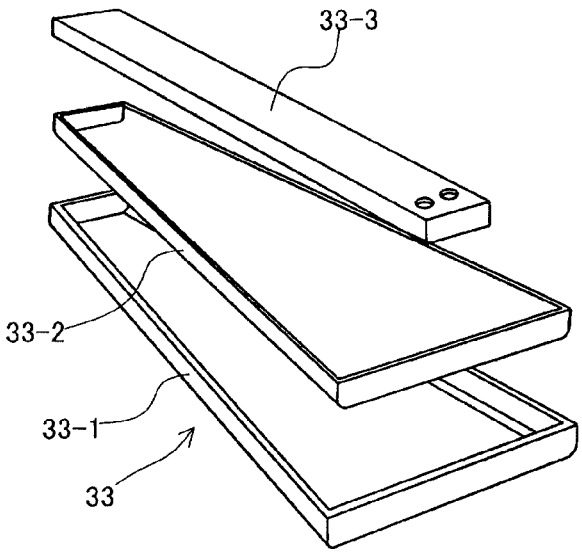
FIGS. 14A through 14C are views each showing an example of an interior structure of the pad-temperature regulator except for the lid.
Figure 14B:
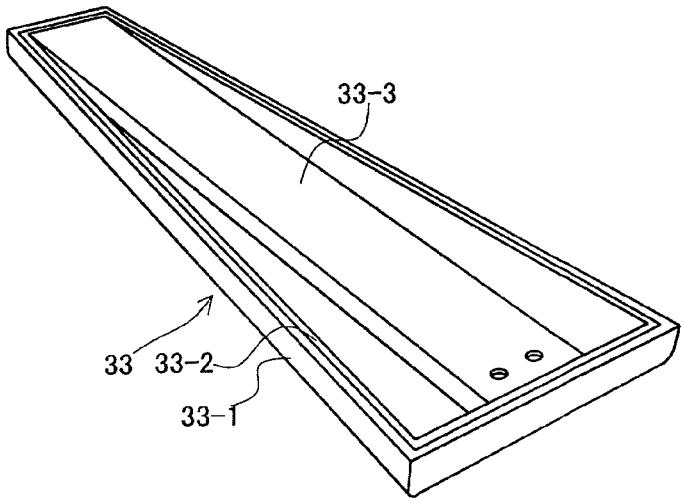
Figure 14C:
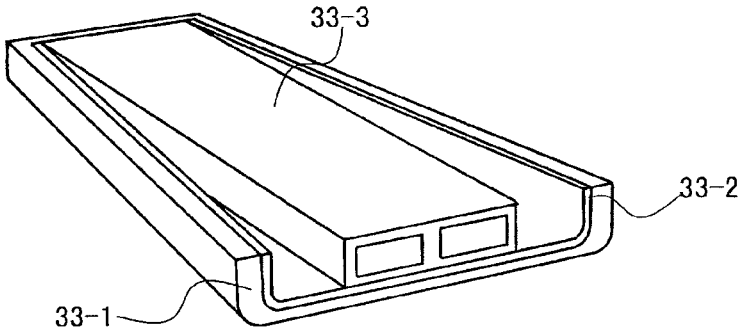

FIGS. 14A through 14C are views each showing an example of an interior structure of the solid member 33 of the pad-temperature regulator 26 except for the lid 35. The interior structure of the solid member 33 in this example differs from the interior structure of the solid member 33 shown in FIG. 9 in that both end portions of the aluminum circulation water case 33-3 have the same width and are made small. As a result, an area of the passages for the cooling water located at the periphery-side portion of the polishing pad 11 becomes small. Therefore, cooling of the corresponding portion of the upper surface of the polishing pad 11 can be suppressed.

Figure 15:
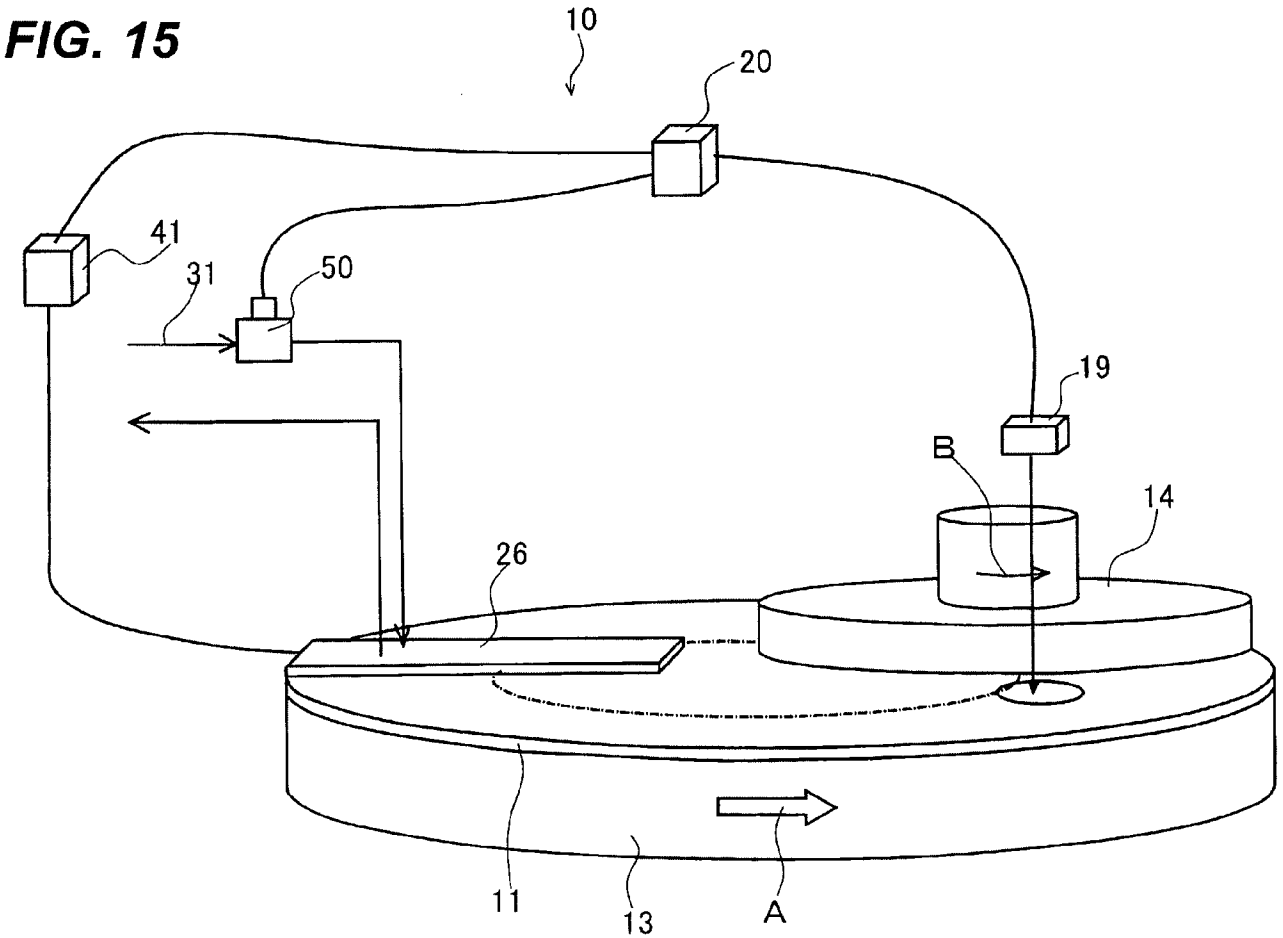
FIG. 15 is a view showing an example of a schematic structure of the substrate polishing apparatus according to the present invention.

FIG. 15 is a view showing an example of a schematic structure of the polishing apparatus according to the present invention. The substrate polishing apparatus 10 has the temperature controller 20 configured to perform PID control on the temperature of the pad-temperature regulator 26 based on the information on the upper surface temperature of the polishing pad 11 measured by the radiation thermometer 19. Specifically, voltage output from a voltage regulator 41 is controlled by output from the temperature controller 20, and this voltage output supplies heating current to the silicone rubber heater 33-2 or the rod heaters 48 of the pad-temperature regulator 26, whereby heating control of the pad-temperature regulator 26 is performed. In this case, the heating current may be supplied and controlled continuously, or may be controlled by time proportion in which an ON-OFF cycle of the heating current is changed. Cooling control of the pad-temperature regulator 26 is performed by a flow-rate controller 50 which regulates a flow rate of the cold water 31 supplied to the solid member 33 of the pad-temperature regulator 26. The flow-rate controller 50 is PID-controlled by the temperature controller 20.

The single temperature controller 20 has a PID parameter for the voltage regulator 41 for the heater (i.e., the silicone rubber heater 33-2 or the rod heaters 48) and a PID parameter for the flow-rate controller 50, i.e., a PID parameter for supply of the heating current and a PID parameter for supply of the cold water. The parameter for heating and the parameter for cooling are written in different lines onto the recipe, so that the temperature controller 20 can distinguish between the parameter for heating (i.e., for supply of the heating current) and the parameter for cooling (i.e., for supply of the cold water).

Figure 16:
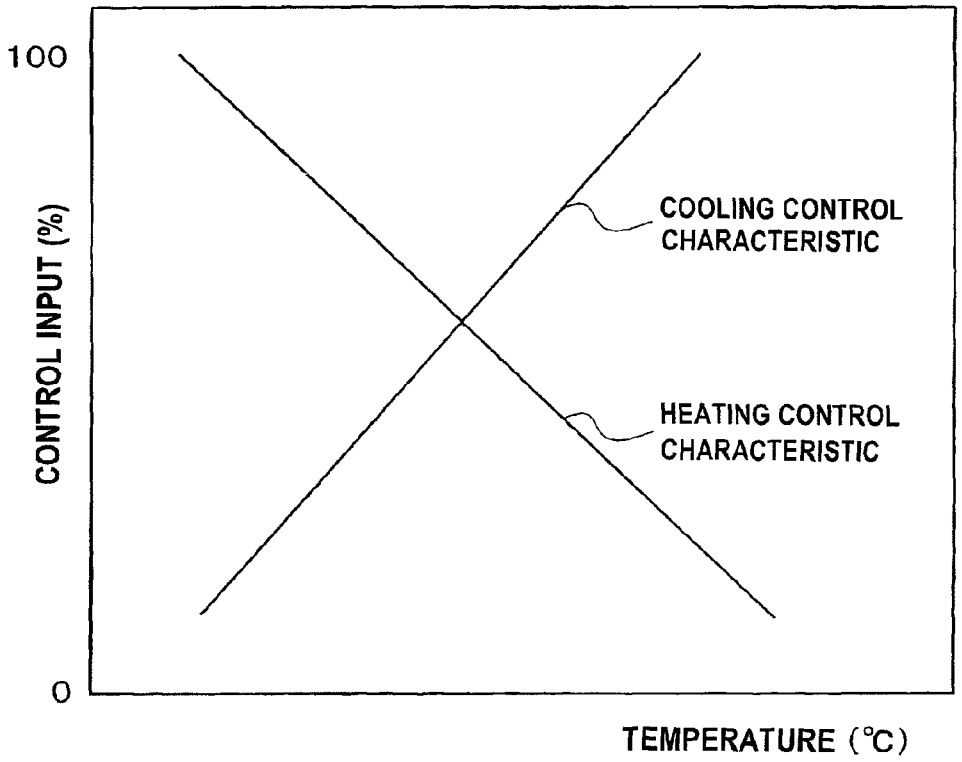
FIG. 16 is a diagram showing a relationship between a control input and temperature in the case of the recipe shown in FIG. 2B.
Figure 17:
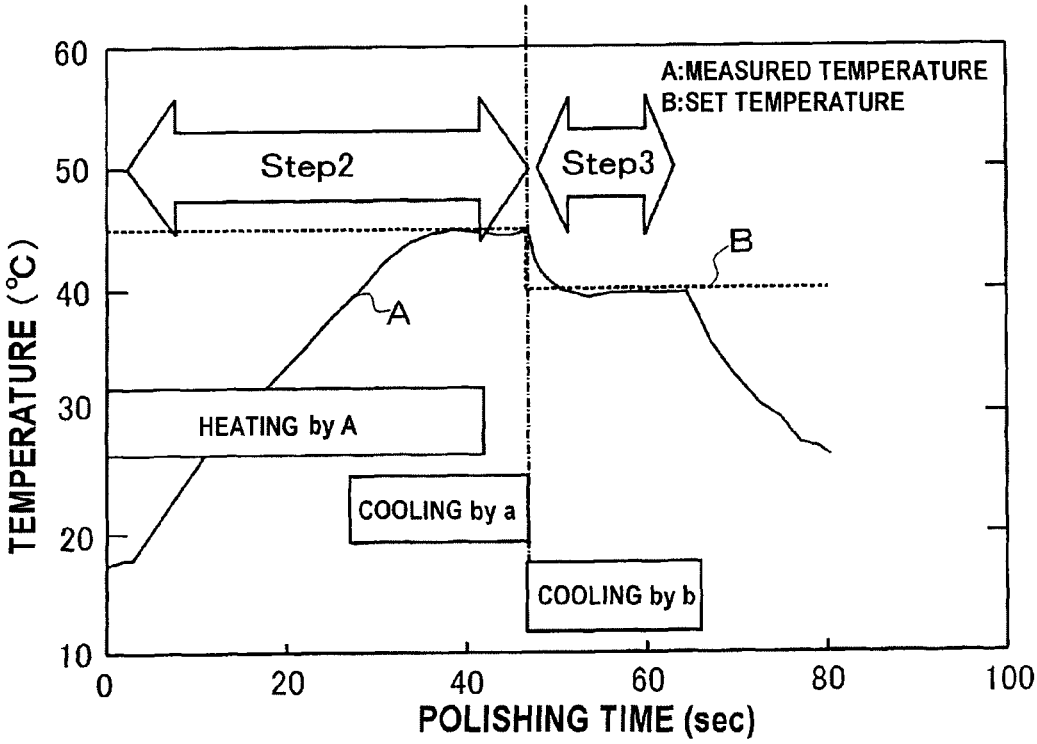
FIG. 17 is a diagram showing a relationship between the polishing time and the temperature of the polishing pad when polishing the substrate in the substrate polishing apparatus according to the present invention.

FIG. 16 is a diagram showing a relationship between control input (in this example, the flow rate of the cold water 31 and the voltage supplied to the heater) and temperature in the case of the recipe shown in FIG. 2B. FIG. 17 is a diagram showing a relationship between the polishing time [sec] and the temperature [° C.]. As shown in FIG. 2B, "processing time", "rotational speed", . . . , "temperature control of the polishing pad", "PID parameter for heating", "PID parameter for cooling", and "set value of temperature (° C.)" are provided as items of the recipe. In this example, the processing time, the rotational speed, valid or invalid for the temperature control of the polishing pad, the PID parameter for heating, the PID parameter for cooling, and the set value of the temperature are set in association with steps 1, 2, 3, . . . , 10.

At step 2 in FIG. 17, in order to reach a desired set temperature B, PID heating control according to control characteristic is performed. When the temperature approaches a predetermined temperature, PID cooling control is also started (while it depends on a value of the PID parameter and on a difference between the predetermined temperature and the desired set temperature). As a result, the PID heating control and the PID cooling control are balanced. The PID parameter used in the heating control is a parameter A, and the PID parameter used in the cooling control is a parameter a. Thereafter, in step 3, only the cooling control is performed using a parameter b, because the desired set temperature is set low.

Figure 13:
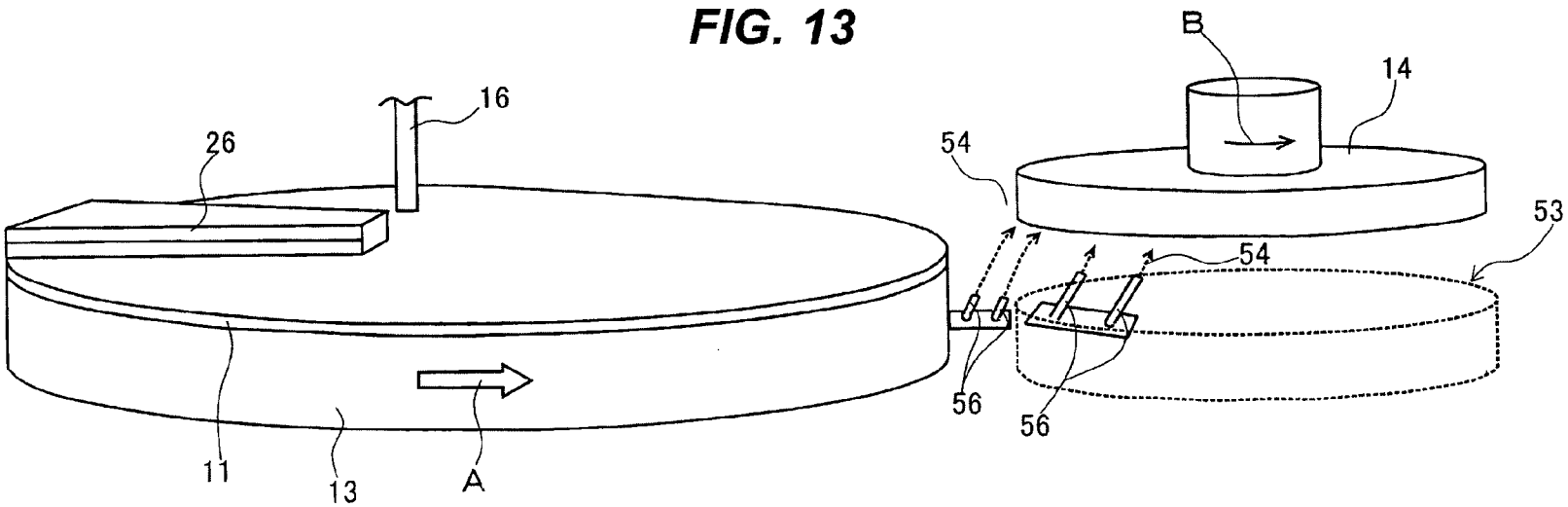
FIG. 13 is a view showing a manner in which hot water is ejected toward a top ring in a substrate transfer position.
Figure 18:
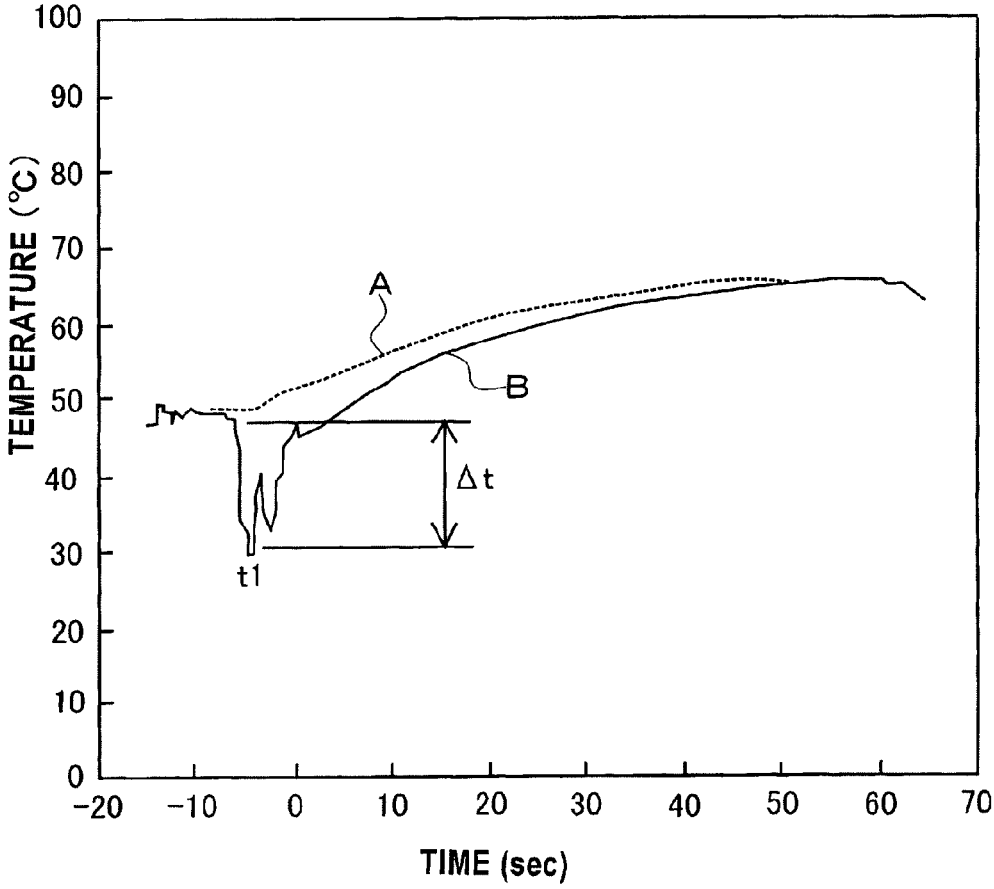
FIG. 18 is a diagram showing a change in temperature of the polishing pad just before polishing of the substrate and during polishing of the substrate.

In the substrate polishing apparatus, when the substrate, to be polished, is brought into contact with the polishing pad 11 at the beginning of substrate polishing, the upper surface temperature of the polishing pad 11 is lowered at a time t1 as indicated by a curved line B in FIG. 18, which means that the upper surface of the polishing pad 11 is cooled. In order to prevent cooling of the upper surface of the polishing pad 11, a heating device for preheating the substrate before the substrate contacts the polishing pad 11 is provided. As such a heating device, nozzles 56 for supplying hot water onto the substrate (not shown) held by the top ring 14 are provided, as shown in FIG. 13. When the top ring 14, holding the substrate, is at rest in a position above a transfer mechanism 53 for transferring the substrate to the top ring 14, hot water 54 is supplied from the nozzles 56 onto the substrate held on the lower surface of the top ring 14 for a predetermined time. The hot water is further supplied onto the substrate even while the top ring 14, holding the substrate, is moving from the position above the transfer mechanism 53 to a position above the polishing position on the polishing pad 11.

In order to prevent the upper surface of the polishing pad 11 from being cooled by contacting the substrate, the heating temperature for the surface of the polishing pad 11 that is set in the temperature controller 20 may be higher than the desired set temperature for substrate polishing, and may be switched to the desired set temperature after the substrate is brought into contact with the polishing pad 11.

Figure 19:
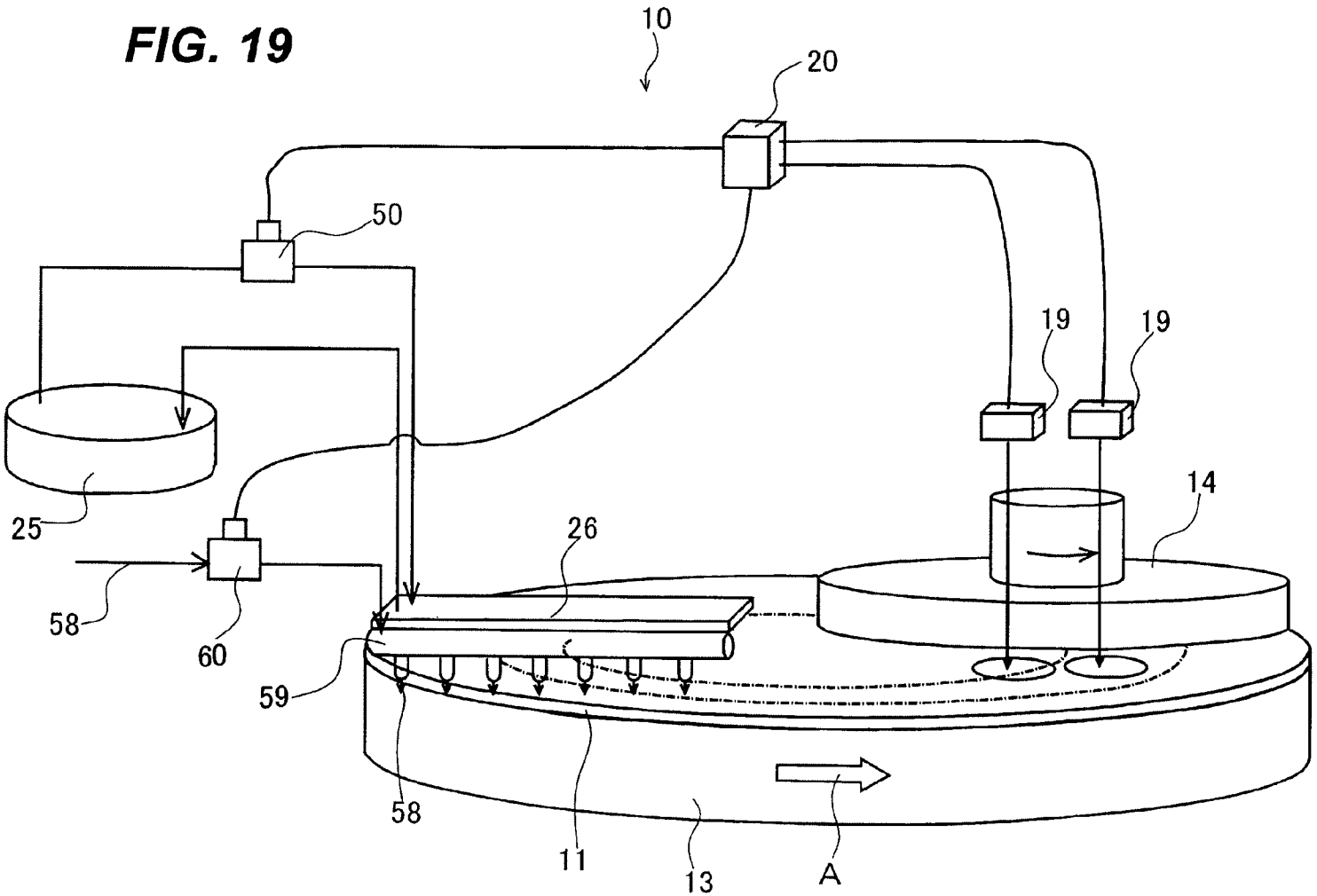
FIG. 19 is a view showing an example of a schematic structure of the substrate polishing apparatus according to the present invention.

FIG. 19 is a view showing another example of a schematic structure of the polishing apparatus according to the present invention. In this substrate polishing apparatus 10, the hot-water producing tank 25 supplies only hot water having a predetermined temperature to the solid member 33 of the pad-temperature regulator 26 so as to heat the upper surface of the polishing pad 11. The flow rate of the hot water is PID-controlled by the temperature controller 20 through the flow-rate controller (e.g., flow control valve) 50. Since an amount of the hot water in the hot-water producing tank 25 should be kept constant, a flow rate of the hot water discharged from the hot-water producing tank 25 should be equal to a flow rate of the hot water recovered into the hot-water producing tank 25. In the case of the system shown in FIG. 1 using the three-way valve 23 that mixes the hot water with the cold water to provide a mixture of fluid which is supplied to the solid member 33 of the pad-temperature regulator 26, it is necessary to perform recovery control for recovering the same flow rate as the flow rate of the hot water discharged from the hot-water producing tank 25. In contrast, in the system shown in FIG. 19 in which the three-way valve is not used and only the hot water circulates at a controlled flow rate, the above-mentioned recovery control is not needed. Moreover, because the hot water is not mixed with the cold water, the temperature of the hot water recovered does not become low. Therefore, a capacity of a heater in the hot-water producing tank 25 can be made small, and power consumption thereof is reduced.

As shown in FIG. 19, cooling nozzles 59 for blowing cooling gas (e.g., cold air) 58 onto the upper surface of the polishing pad 11 are provided as a cooling mechanism for the upper surface of the polishing pad 11. An opening degree of an electropneumatic regulator 60 is regulated by the PID control performed by the temperature controller 20 to thereby control a flow rate of the cooling gas 58 directed to the polishing pad 11. A gas having a normal temperature or a predetermined temperature is used as the cooling gas 58.

Figure 20:
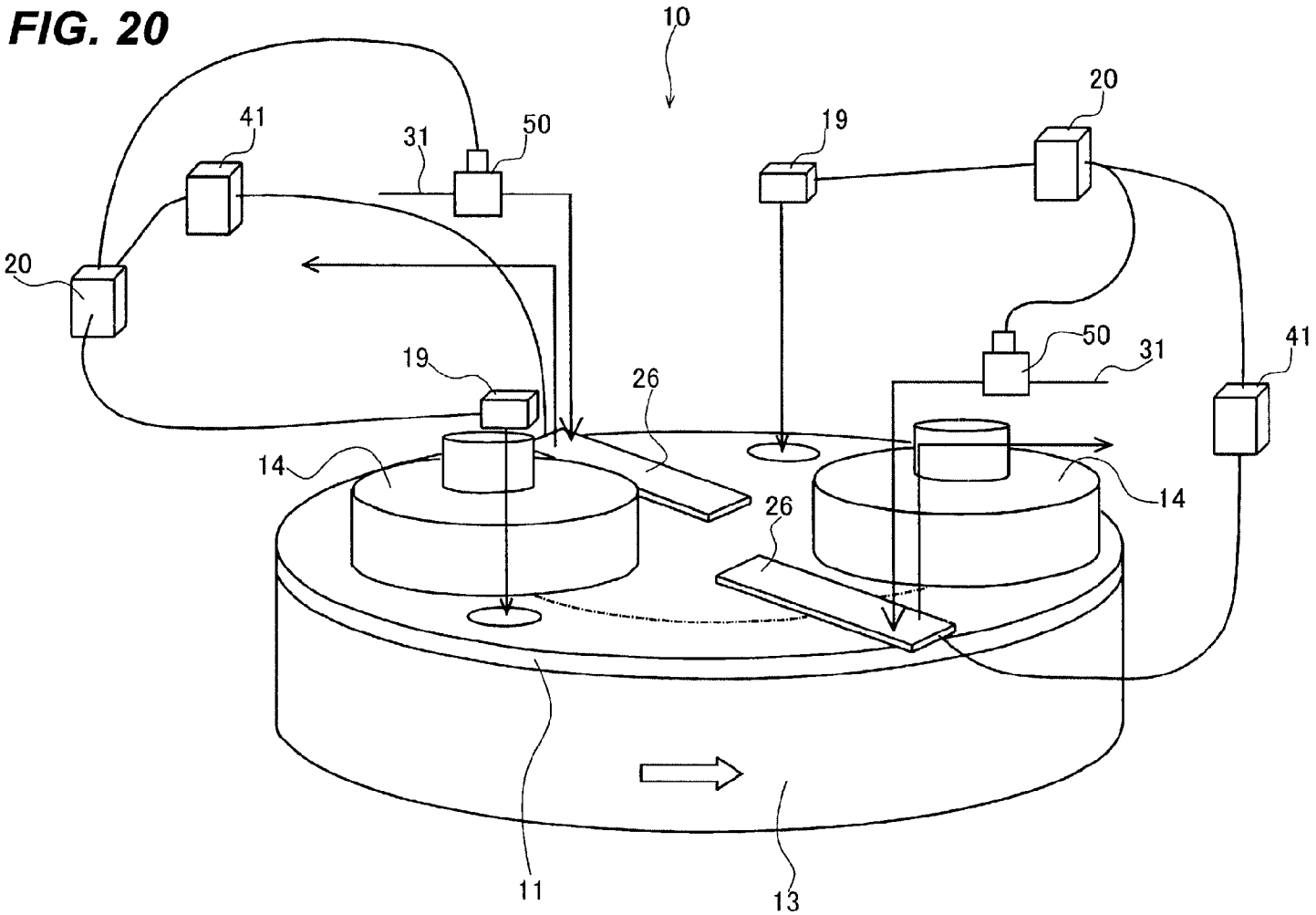
FIG. 20 is a view showing an example of a schematic structure of the substrate polishing apparatus according to the present invention.

While the substrate polishing apparatus 10 according to the above-described embodiments has one polishing table 13 and one top ring 14, the substrate polishing apparatus according to the present invention is not limited to this configuration. As shown in FIG. 20, the substrate polishing apparatus may have one polishing table 13 and a plurality of (two in the drawing) top rings 14 each for holding and pressing the substrate to polish it. In this case, the radiation thermometer 19, the pad-temperature regulator 26, the temperature controller 20, the voltage regulator 41, and the flow-rate controller 50 are provided for each top ring 14.

When the two top rings 14 hold substrates and press them against the upper surface of the polishing pad 11 so as to polish the substrates, a double amount of heat is generated by polishing of the substrates as compared with the case of using one top ring 14. Consequently, the temperature of the polishing pad 11 is increased. Thus, the radiation thermometer 19, the pad-temperature regulator 26, the temperature controller 20, the voltage regulator 41, and the flow-rate controller 50 are provided for each of the top rings 14. As with the system of the substrate polishing apparatus shown in FIG. 15, the temperature control of each pad-temperature regulator 26 is performed by the PID control of the temperature controller 20 based on the information on the upper surface temperature of the polishing pad 11 detected by the radiation thermometer 19. Specifically, the heating control of each pad-temperature regulator 26 is performed by controlling the output voltage of the voltage regulator 41 so as to control the heating current supplied to the silicone rubber heater 33-2 or the rod heaters 48. The cooling control of each pad-temperature regulator 26 is performed by controlling the flow-rate controller 50 so as to control the flow rate of the cold water 31 flowing through the passages of the solid member 33 of the pad-temperature regulator 26. With these operations, the upper surface temperature of the polishing pad 11 can be kept at an optimum temperature for polishing. FIG. 20 shows an example of a temperature regulating system for the multiple top rings 14 of the substrate polishing apparatus. Other temperature regulating system as shown in FIG. 1 and FIG. 19 may be used for the multiple top rings 14.

As described above, the substrate polishing apparatus having one polishing table and a plurality of top rings can also achieve an optimum polishing rate and an optimum step property by providing the radiation thermometer, the pad-temperature regulator, the temperature controller, and other devices for each top ring and by performing the temperature control of the pad-temperature regulator using the temperature controller that performs PID control based on the information on the upper surface temperature of the polishing pad measured by the radiation thermometer.

The top rings or the film of the substrates may cause a variation in the polishing rate between the substrates. As described above, even in the case where a plurality of top rings are provided and perform the same process simultaneously, an optimum polishing rate and an optimum step property can be obtained by controlling the upper surface temperature of the polishing pad despite the difference between the top rings, because the temperature control can be performed for each of the top rings. Further, the upper surface temperature of the polishing pad when polishing one substrate (e.g., when polishing a 25-th substrate) does not rise higher than when polishing two substrates simultaneously. Therefore, by using the above-described temperature control of the upper surface of the polishing pad, an optimum polishing rate and an optimum step property can be obtained even in the case of polishing one substrate as well as the case of polishing two substrates. For example, the same level of polishing in one cassette can be achieved.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A substrate polishing apparatus for polishing a substrate, said substrate polishing apparatus comprising:

a rotatable polishing table on which a polishing pad is attached;

at least one substrate holder configured to hold a substrate and press the substrate against a polishing surface of the polishing pad on said rotatable polishing table so as to polish the substrate;

a pad-temperature detector configured to detect a temperature of the polishing surface of the polishing pad;

a pad-temperature regulator configured to contact the polishing surface of the polishing pad to regulate the temperature of the polishing surface; and a temperature controller configured to control the temperature of the polishing surface of the polishing pad by controlling said pad-temperature regulator based on information on the temperature of the polishing surface detected by said pad-temperature detector, wherein said temperature controller is configured to select a proportional integral derivative (PID) parameter from several kinds of PID parameters based on a difference between a set temperature and the detected temperature of the polishing surface of the polishing pad and to control the temperature of the polishing surface of the polishing pad using the selected PID parameter based on the information on the temperature of the polishing surface.

2. The substrate polishing apparatus according to claim 1, wherein said temperature controller stores therein the several kinds of PID parameters including a PID parameter for cooling the polishing surface of the polishing pad and a PID parameter for heating the polishing surface of the polishing pad.

3. The substrate polishing apparatus according to claim 2, wherein the PID parameter is registered in advance in a recipe and said temperature controller selects the PID parameter in accordance with the recipe.

4. The substrate polishing apparatus according to claim 1, wherein said pad-temperature regulator has a solid member having a fluid passage formed therein and having a contact surface which is brought into contact with the polishing surface of the polishing pad, said contact surface extends in a radial direction of the polishing surface, and said pad-temperature regulator is configured to perform heat exchange between a fluid flowing in said fluid passage of said solid member and the polishing pad through said contact surface of said solid member.

5. The substrate polishing apparatus according to claim 1, further comprising:

a head section for supporting said substrate holder; and a hot-blast heater configured to blow hot gas onto the polishing surface of the polishing pad, said hot-blast heater being provided on said head section.

6. The substrate polishing apparatus according to claim 1, further comprising:

a cold-gas blower configured to blow cold gas onto the polishing surface of the polishing pad.

7. The substrate polishing apparatus according to claim 1, further comprising:

a substrate heating device configured to heat the substrate when held by said substrate holder.

8. The substrate polishing apparatus according to claim 7, wherein said substrate heating device comprises a hot-water supplying device configured to supply hot water onto the substrate.

9. A substrate polishing apparatus for polishing a substrate, said substrate polishing apparatus comprising:

a rotatable polishing table on which a polishing pad is attached;

a plurality of substrate holders each configured to hold a substrate and press the substrate against a polishing surface of the polishing pad on said rotatable polishing table so as to polish the substrate;

a pad-temperature detector for each of said substrate holders, each of said pad-temperature detectors being configured to detect a temperature of the polishing surface of the polishing pad;

a pad-temperature regulator for each of said substrate holders, each of said pad-temperature regulators being configured to contact the polishing surface of the polishing pad to regulate the temperature of the polishing surface; and a temperature controller for each of said substrate holders, each of said temperature controllers being configured to control the temperature of the polishing surface of the polishing pad by controlling a respective one of said pad-temperature regulators based on information on the temperature of the polishing surface detected by a respective one of said pad-temperature detectors, wherein each of said temperature controllers is configured to select a proportional integral derivative (PID) parameter from several kinds of PID parameters based on a predetermined rule and to control the temperature of the polishing surface of the polishing pad using the selected PID parameter based on the information on the temperature of the polishing surface.

10. A substrate polishing apparatus for polishing a substrate, said substrate polishing apparatus comprising:

a rotatable polishing table on which a polishing pad is attached;

at least one substrate holder configured to hold a substrate and press the substrate against a polishing surface of the polishing pad on said rotatable polishing table so as to polish the substrate;

a pad-temperature detector configured to detect a temperature of the polishing surface of the polishing pad;

a pad-temperature regulator configured to contact the polishing surface of the polishing pad to regulate the temperature of the polishing surface; and a temperature controller configured to control the temperature of the polishing surface of the polishing pad by controlling said pad-temperature regulator based on information on the temperature of the polishing surface detected by said pad-temperature detector, wherein said temperature controller is configured to control the temperature of the polishing surface of the polishing pad using a proportional integral derivative (PID) parameter selected from several kinds of PID parameters in accordance with a type of film of the substrate.

11. A pad-temperature regulating apparatus for regulating a temperature of a polishing surface of a polishing pad for use in a substrate polishing apparatus, said pad-temperature regulating apparatus comprising:

a solid member having a fluid passage formed therein and including a pad contact member and an insulating cover disposed on said pad contact member, wherein said pad contact member has a contact surface to be brought into contact with the polishing surface of the polishing pad, wherein said pad contact member is made of ceramics, wherein said insulating cover is arranged at an opposite side of said contact surface, wherein said insulating cover is made of material whose linear expansion coefficient is close to that of said pad contact member, wherein said solid member is configured to perform heat exchange between a fluid flowing in said fluid passage of said solid member and the polishing surface of the polishing pad through said contact surface, and wherein said contact surface of said solid member comprises a mirror-finished contact surface, or a chemical vapor deposition (CVD) coating is applied to said contact surface for reducing surface roughness of said contact surface.

12. The pad-temperature regulating apparatus according to claim 11, wherein said pad contact member is made of SiC or alumina.

13. The pad-temperature regulating apparatus according to claim 11, further comprising:

a follow mechanism configured to allow said solid member to follow deflection of the polishing surface in a circumferential direction and a radial direction and to follow a change in thickness of the polishing pad as a result of wear thereof, wherein said solid member is shaped so as to extend in the radial direction and is placed in contact with the polishing surface by its own weight.

14. The pad-temperature regulating apparatus according to claim 11, further comprising:

a raising mechanism capable of raising up said solid member to an upright position at a periphery of the polishing pad so that said solid member does not hinder replacement of the polishing pad.

15. The pad-temperature regulating apparatus according to claim 11, wherein said solid member has at least one first fluid port provided on one end portion thereof located at a center-side portion of the polishing pad and at least one second fluid port provided on another end portion thereof located at a periphery-side portion of the polishing pad, and the fluid is introduced into and discharged from said fluid passage of said solid member through said first fluid port and said second fluid port.

16. The pad-temperature regulating apparatus according to claim 15, wherein when cooling the polishing surface of the polishing pad, the fluid is supplied into said first fluid port located at the center-side portion of the polishing surface and is discharged from said second fluid port located at the periphery-side portion of the polishing pad.

17. The pad-temperature regulating apparatus according to claim 15, wherein when heating the polishing surface of the polishing pad, the fluid is supplied into said second fluid port located at the periphery-side portion of the polishing pad and is discharged from said first fluid port located at the center-side portion of the polishing surface.

18. The pad-temperature regulating apparatus according to claim 15, wherein said at least one first fluid port comprises one fluid port, and said at least one second fluid port comprises at least two fluid ports.

19. The pad-temperature regulating apparatus according to claim 11, wherein said solid member has a trapezoidal shape, as viewed from above, which has a narrow end portion contacting a center-side portion of the polishing pad and a wide end portion contacting a periphery-side portion of the polishing pad.

20. The pad-temperature regulating apparatus according to claim 11, wherein the fluid is liquid or gas.

21. A pad-temperature regulating apparatus for regulating a temperature of a polishing surface of a polishing pad for use in a substrate polishing apparatus, said pad-temperature regulating apparatus comprising:

a solid member having a fluid passage formed therein and including a pad contact member and an insulating cover disposed on said pad contact member; and a proportional control three-way valve through which fluid is supplied into said fluid passage of said solid member, wherein said pad contact member has a contact surface to be brought into contact with the polishing surface of the polishing pad, wherein said pad contact member is made of ceramics, wherein said insulating cover is arranged at an opposite side of said contact surface, wherein said insulating cover is made of material whose linear expansion coefficient is close to that of said pad contact member, wherein said solid member is configured to perform heat exchange between the fluid flowing in said fluid passage of said solid member and the polishing surface of the polishing pad through said contact surface, and wherein hot fluid and cold fluid are supplied to said proportional control three-way valve, and the hot fluid and the cold fluid are mixed by said proportional control three-way valve at regulated flow rates, respectively, to form the fluid having a controlled temperature.

* * * * *